US007454150B2

(12) United States Patent
Matsuda et al.

(10) Patent No.: US 7,454,150 B2
(45) Date of Patent: Nov. 18, 2008

(54) IMAGE FORMING APPARATUS HAVING A RESIST ROTARY MEMBER

(75) Inventors: Hiromichi Matsuda, Kanagawa (JP); Toshiyuki Andoh, Kanagawa (JP); Masato Yokoyama, Kanagawa (JP); Kazuhiko Kobayashi, Tokyo (JP); Yuji Matsuda, Tokyo (JP); Yohei Miura, Tokyo (JP); Hiroshi Okamura, Kanagawa (JP); Nobuto Yokokawa, Kanagawa (JP); Ryoji Imai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 203 days.

(21) Appl. No.: 11/327,520

(22) Filed: Jan. 9, 2006

(65) Prior Publication Data

US 2006/0153604 A1 Jul. 13, 2006

(30) Foreign Application Priority Data

Jan. 11, 2005 (JP) ..... 2005-004593

(51) Int. Cl.
*G03G 15/00* (2006.01)
*G03G 15/16* (2006.01)
*G03G 15/20* (2006.01)

(52) U.S. Cl. ..... 399/68; 399/301; 399/396

(58) Field of Classification Search ..... 399/67, 399/68, 9, 16, 167, 301, 394, 396
See application file for complete search history.

(56) References Cited

U.S. PATENT DOCUMENTS

| | | | | |
|---|---|---|---|---|
| 6,345,171 | B1 * | 2/2002 | Suga | 399/396 |
| 6,941,096 | B2 | 9/2005 | Matsuda et al. | 399/167 |
| 6,949,896 | B2 | 9/2005 | Andoh et al. | 318/135 |
| 2005/0053388 | A1 | 3/2005 | Yokoyama et al. | 399/66 |
| 2005/0191103 | A1 * | 9/2005 | Kobayashi | 399/394 |

FOREIGN PATENT DOCUMENTS

| | | |
|---|---|---|
| JP | 11-263484 | 9/1999 |
| JP | 2004-149265 | 5/2004 |
| JP | 2004-151382 | 5/2004 |
| JP | 2004-151383 | 5/2004 |
| JP | 2004-151384 | 5/2004 |

* cited by examiner

*Primary Examiner*—Sophia S Chen
(74) *Attorney, Agent, or Firm*—Harness, Dickey & Pierce, P.L.C.

(57) ABSTRACT

An image forming apparatus includes a belt stretched across rollers and a resist rotary member that feeds out a recording medium on the belt. A correlation between a velocity of the belt and the resist rotary member is obtained. A target velocity of the belt or the resist rotary member, at which a difference between the velocity when the recording medium is in contact with both the belt and the resist rotary member and the velocity when the recording medium is not in contact with at least either the belt or the resist rotary member is minimum, is determined based on the correlation.

4 Claims, 9 Drawing Sheets

IMAGE FORMING APPARATUS HAVING A RESIST ROTARY MEMBER

CROSS-REFERENCE TO RELATED APPLICATIONS

The present document incorporates by reference the entire contents of Japanese priority document, 2005-004593 filed in Japan on Jan. 11, 2005.

BACKGROUND OF THE INVENTION

1. Field of the Invention

The present invention relates to an image forming apparatus including a resist rotary member that feeds out a recording member to a belt member and a fixing rotary member that fixes a toner on the recording member.

2. Description of the Related Art

An increase in printing speed of color image forming apparatuses is strongly demanded. To meet this demand, so-called tandem type color image forming apparatuses have become popular. These apparatuses employ a direct transfer system or an intermediate transfer system in which transfer areas for a plurality of image carriers are located on a feed path for a recording member. The tandem type color image forming apparatus using the direct transfer system feeds a recording member by carrying it on a surface of a paper feeding belt (recording member feeding unit). A color image is formed on the recording member by sequentially transferring toner images on individual image carriers onto the recording member, which is fed out by a resist roller (resist rotary member) and conveyed on the paper feeding belt, one on another. The tandem type color image forming apparatus using the intermediate transfer system sequentially transfers toner images on individual image carriers onto an intermediate transfer body one on top of another. The color images on the intermediate transfer body are transferred at one time onto a transfer member fed out by the resist roller.

In the tandem type color image forming apparatus, if the velocity of the circumferential surface of the resist roller (resist linear velocity) differs from the surface velocity of the paper feeding belt (belt moving velocity), the color registration can be shift.

The following describes why the color registration shifts in the tandem type color image forming apparatus employing the direct transfer system having four image carriers when the resist linear velocity differs from the velocity of the paper feeding belt. In the following explanation, a first image carrier, a second image carrier, a third image carrier, and a fourth image carrier are laid out from the resist roller in this order.

An example in which the resist linear velocity is set faster than the belt moving velocity of the paper feeding belt is explained first. A recording member fed out from the resist roller adsorbs on the paper feeding belt, and is fed to a transfer area of each image carrier according to the surface movement of the paper feeding belt. Ideally, the recording member and the paper feeding belt are completely in contact with each other and are not influenced at all by disturbance, in which case, color registration is hardly shifted. However, in reality, disturbance causes sliding of several micrometers to several hundred micrometers between the recording member and the paper feeding belt. The disturbance may change the load applied to the paper feeding belt, so that the belt moving velocity changes. The disturbance that causes such sliding or a change in the belt moving velocity is mainly the influence of a resist roller that is driven at a resist linear velocity that does not coincide with the belt moving velocity of the paper feeding belt. Specifically, when a recording member is fed out from the resist roller which is driven at a resist linear velocity Vr, the recording member adsorbs on the paper feeding belt driven at a belt moving velocity Vt (Vt<Vr). The moving velocity of the part of the recording member which adsorbs on the paper feeding belt is Vta (Vt<Vta<Vr), not Vt that is the same as the belt moving velocity, and the leading end of the recording member enters the transfer area of the first image carrier at the moving velocity Vta. As the recording member is fed thereafter, the contact area between the recording member and the paper feeding belt increases, so that the moving velocity of the recording member is dominated by the paper feeding belt rather than by the resist roller. By the time the leading end of the recording member reaches the transfer area of the fourth image carrier, the moving velocity of the recording member approximately matches with the belt moving velocity Vt of the paper feeding belt. In the tandem type color image forming apparatus using the direct transfer system, if the moving velocities of the recording member when passing the transfer areas of the individual image carriers do not coincide with one another, the color registration shifts. In the above example, the moving velocity of the recording member is Vta when passing the transfer area of the first image carrier, becomes slower gradually thereafter, and becomes Vt when passing the transfer area of the fourth image carrier. Accordingly, toner images of the individual colors to be transferred from the respective image carriers are transferred at positions shifted from one another by that difference, resulting in the shift of color registration.

An example in which the resist linear velocity is set slower than the belt moving velocity of the paper feeding belt is explained. When a recording member is fed out from the resist roller which is driven at a resist linear velocity Vr, the recording member adsorbs on the paper feeding belt driven at a belt moving velocity Vt (Vt>Vr). The moving velocity of the part of the recording member which adsorbs on the paper feeding belt is Vta' (Vt>Vta'>Vr), not Vt that is the same as the belt moving velocity, and the leading end of the recording member enters the transfer area of the first image carrier at the moving velocity Vta'. As the recording member is fed thereafter, the contact area between the recording member and the paper feeding belt increases, so that the moving velocity of the recording member is dominated by the paper feeding belt rather than by the resist roller. By the time the leading end of the recording member reaches the transfer area of the fourth image carrier, the moving velocity of the recording member approximately matches with the belt moving velocity Vt of the paper feeding belt. The moving velocity of the recording member is Vta' when passing the transfer area of the first image carrier, becomes faster gradually thereafter, and becomes Vt when passing the transfer area of the fourth image carrier. Accordingly, toner images of the individual colors to be transferred from the respective image carriers are transferred at positions shifted from one another by that difference, resulting in the shift of color registration.

The shift of color registration can be also caused by disturbance originating from the linear velocity of a fixing rotary member, such as fixing rollers that hold the recording member at the downstream of the paper feeding belt in the feed direction of the recording member.

The following technique is conventionally known to prevent such out of color registration. For example, the recording member feeding velocity of the resist roller is set slightly faster than the recording member feeding velocity of the paper feeding belt (transfer belt), and the resist roller is disposed askew in the vertical direction with respect to the recording member inlet port of the paper feeding belt. The velocity setting and the layout of the resist roller flex the recording member between the paper feeding belt and the resist roller to absorb the difference between the belt moving velocity and the velocity of feeding the recording member by the resist roller. This technique is also adaptable to the velocity difference between the fixing rotary member and the transfer belt.

To downsize an image forming apparatus, however, the distance between the paper feeding belt and the resist roller, and the distance between the paper feeding belt and the fixing rotary member should be made shorter. This makes it difficult to secure a sufficient space for flexing the recording member to absorb the velocity difference between them. When the recording member has a high rigidity to flexibility in the feed direction, such as thick paper, even when the recording member is flexed between the paper feeding belt and the resist roller, the rigidity causes the disturbance to be transmitted to the paper feeding belt. The diameter of the resist roller can change due to the environment, such as temperature and humidity, and a frictional force between the recording member and the resist roller can change due to aging abrasion, or adhesion of paper dust or the like, which can change the feeding velocity of the recording member by the resist roller. It is therefore difficult to keep the initially set moving velocity of the paper feeding belt and the initially set recording member feeding velocity of the resist roller for a long period.

As a solution to the problem originating from the feeding of the recording member in a flexed manner, Japanese Patent Application Laid-Open No. 2004-151382 discloses a scheme using a detector that detects a rotational velocity of a transfer belt (paper feeding belt), and a detector that detects a feeding velocity of a recording paper. The scheme detects the moving velocity of the transfer belt, and the recording member feeding velocity of the resist roller, and controls the rotational velocity of the resist roller so that the recording member feeding velocity of the resist roller becomes slightly faster than the moving velocity of the transfer belt with a predetermined velocity difference maintained.

However, comparison of the velocities detected by the two detectors proposed in Japanese Patent Application Laid-Open No. 2004-151382 requires high precision of both detectors. For example, there is a method of measuring the feeding velocity of a recording member fed out by the resist roller. The method uses two optical sensors, laid out in parallel in the feed direction to measure the time for the leading end or the trailing end of the recording member to pass the two sensors. A calculation of the feeding velocity of the recording member from the measured pass time requires an exact distance between the two sensors. The moving velocity of the transfer belt can be measured by a method of measuring the amount of the rotation of an adsorption roller that rotates with the surface movement of the transfer belt. The adsorption roller is provided to face a driven roller with the transfer belt provided in between, and electrostatically adsorbs the recording member to the transfer belt. A calculation of the moving velocity of the transfer belt from the rotational amount of the adsorption roller requires an exact value of the circumferential length of the adsorption roller. When the exact values are not known in advance, the set value of the rotational velocity of the resist motor does not become a proper value. The distance between the two sensors differs from one product to another due to a difference in mounting precision. The circumferential length of the resist roller differs from one product to another due to a difference in the precision of parts. It is therefore difficult to calculate the adequate set values for each individual product.

SUMMARY OF THE INVENTION

It is an object of the present invention to at least solve the problems in the conventional technology.

According to an aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a resist rotary member that feeds out a recording medium on the belt at a predetermined timing, a resist-rotary-member driver configured to rotate the resist rotary member at a plurality of different second velocities, a rotation controlling unit configured to rotate any one of the drive roller with the first velocities and the resist rotary member with the second velocities, and obtains a correlation between information detected by the detector and any one of the first velocities and the second velocities, and a target velocity determining unit that determines a target velocity at which a difference between information when the recording medium is in contact with both the belt and the resist rotary member and information when the recording medium is not in contact with at least any one of the belt and the resist rotary member is minimum from the correlation, wherein any one of the drive-roller driver rotates the drive roller and the resist-rotary-member driver rotates the resist rotary member at the target velocity.

According to another aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a resist rotary member that feeds out a recording medium on the belt at a predetermined timing, a resist-rotary-member driver configured to rotate the resist rotary member at a plurality of different second velocities, a rotation controlling unit configured to rotate any one of the drive roller with the first velocities and the resist rotary member with the second velocities, and obtains a correlation between information detected by the detector and any one of the first velocities and the second velocities, and a target velocity determining unit that determines a target velocity at which a fluctuation magnitude of information when a trailing end of the recording medium passes the resist rotary member while the recording medium is in contact with the belt from the correlation, wherein any one of the drive-roller driver rotates the drive roller and the resist-rotary-member driver rotates the resist rotary member at the target velocity.

According to still another aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a fixing rotary member that fixes an image formed on a recording medium conveyed on the belt by sandwiching the recording medium with the belt, a fixing-rotary-member driver configured to rotate the fixing rotary member at a plurality of different second velocities, a rotation controlling unit configured to rotate any one of the drive roller with the first velocities and the fixing rotary member with the second velocities, and obtains a correlation between information detected by the detector and any one of the first velocities and the second velocities, and a target velocity determining unit that determines a target velocity at which a difference between information when the recording medium is in contact with both the belt and the fixing rotary member and information when the recording medium is not in contact with at least any one of the belt and the fixing rotary member is minimum from the correlation, wherein any one of the drive-roller driver rotates the drive roller and the fixing-rotary-member driver rotates the fixing rotary member at the target velocity.

According to still another aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a fixing rotary member that fixes an image formed on a recording medium conveyed on the belt by sandwiching the recording medium with the belt, a fixing-rotary-member driver configured to rotate the fixing rotary member at a plurality of different second velocities, a rotation controlling unit configured to rotate any one of the drive roller with the first velocities and the fixing rotary member with the second velocities, and obtains a correlation between information detected by the detector and any one of the first velocities and the second velocities, and a target velocity determining unit that determines a target velocity at which a fluctuation magnitude of information when a trailing end of the recording medium passes the fixing rotary member while the recording medium is in contact with the belt from the correlation, wherein any one of the drive-roller driver rotates the drive roller and the fixing-rotary-member driver rotates the fixing rotary member at the target velocity.

According to still another aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a resist rotary member that feeds out a recording medium on the belt at a predetermined timing, a resist-rotary-member driver configured to rotate the resist rotary member at a plurality of different second velocities, a rotation controlling unit configured to cause any one of the drive-roller driver to be subjected to a feedback control so that the information detected by the detector becomes a target information and the drive roller is rotated at first velocities and the resist rotary member to be rotated at the second velocities, acquire a plurality of control information representative of any one of drive information with which the drive roller is rotating or drive-roller driving information output by the controller when the recording medium is in contact with both the belt and the resist rotary member, and obtain a correlation between the information detected by the detector and any one of the first velocities and the second velocities based on the control information acquired, and a target velocity determining unit that determines a target velocity at which a difference between control information when the recording medium is in contact with both the belt and the resist rotary member and control information when the recording medium is not in contact with at least any one of the belt and the resist rotary member is minimum from the correlation, wherein any one of the drive-roller driver rotates the drive roller and the resist-rotary-member driver rotates the resist rotary member at the target velocity.

According to still another aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a resist rotary member that feeds out a recording medium on the belt at a predetermined timing, a resist-rotary-member driver configured to rotate the resist rotary member at a plurality of different second velocities, a rotation controlling unit configured to cause any one of the drive-roller driver to be subjected to a feedback control so that the information detected by the detector becomes a target information and the drive roller is rotated at first velocities and the resist rotary member to be rotated at the second velocities, acquire a plurality of control information representative of any one of drive information with which the drive roller is rotating or drive-roller driving information output by the controller when the recording medium is in contact with both the belt and the resist rotary member, and obtain a correlation between the information detected by the detector and any one of the first velocities and the second velocities based on the control information acquired, and a target velocity determining unit that determines a target velocity at which a fluctuation magnitude of control information when a trailing end of the recording medium passes the resist rotary member while the recording medium is in contact with the belt from the correlation, wherein any one of the drive-roller driver rotates the drive roller and the resist-rotary-member driver rotates the resist rotary member at the target velocity.

According to still another aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a fixing rotary member that feeds out a recording medium on the belt at a predetermined timing, a fixing-rotary-member driver configured to rotate the fixing rotary member at a plurality of different second velocities, a rotation controlling unit configured to cause any one of the drive-roller driver to be subjected to a feedback control so that the information detected by the detector becomes a target information and the drive roller is rotated at first velocities and the fixing rotary member to be rotated at the second velocities, acquire a plurality of control information representative of any one of drive information with which the drive roller is rotating or drive-roller driving information output by the controller when the recording medium is in contact with both the belt and the fixing rotary member, and obtain a correlation between the information detected by the detector and any one of the first velocities and the second velocities based on the control information acquired, and a target velocity determining unit that determines a target velocity at which a difference between control information when the recording medium is in contact with both the belt and the fixing rotary member and control information when the recording medium is not in contact with at least any one of the belt and the fixing rotary member is minimum from the correlation, wherein any one of the drive-roller driver rotates the drive roller and the fixing-rotary-member driver rotates the fixing rotary member at the target velocity.

According to still another aspect of the present invention, an image forming apparatus includes a belt endlessly stretched across a drive roller and a plurality of driven rollers, a drive-roller driver configured to rotate the drive roller at a plurality of different first velocities, a detector that detects information representative of any one of a rotational displacement and a velocity of at least one driven roller, a fixing rotary member that feeds out a recording medium on the belt at a predetermined timing, a fixing-rotary-member driver configured to rotate the fixing rotary member at a plurality of different second velocities, a rotation controlling unit configured to cause any one of the drive-roller driver to be subjected to a feedback control so that the information detected by the detector becomes a target information and the drive roller is rotated at first velocities and the fixing rotary member to be rotated at the second velocities, acquire a plurality of control information representative of any one of drive information with which the drive roller is rotating or drive-roller driving information output by the controller when the recording medium is in contact with both the belt and the fixing rotary member, and obtain a correlation between the information detected by the detector and any one of the first velocities and the second velocities based on the control information acquired, and a target velocity determining unit that determines a target velocity at which a fluctuation magnitude of control information when a trailing end of the recording medium passes the fixing rotary member while the recording medium is in contact with the belt from the correlation, wherein any one of the drive-roller driver rotates the drive roller and the fixing-rotary-member driver rotates the fixing rotary member at the target velocity.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 2:
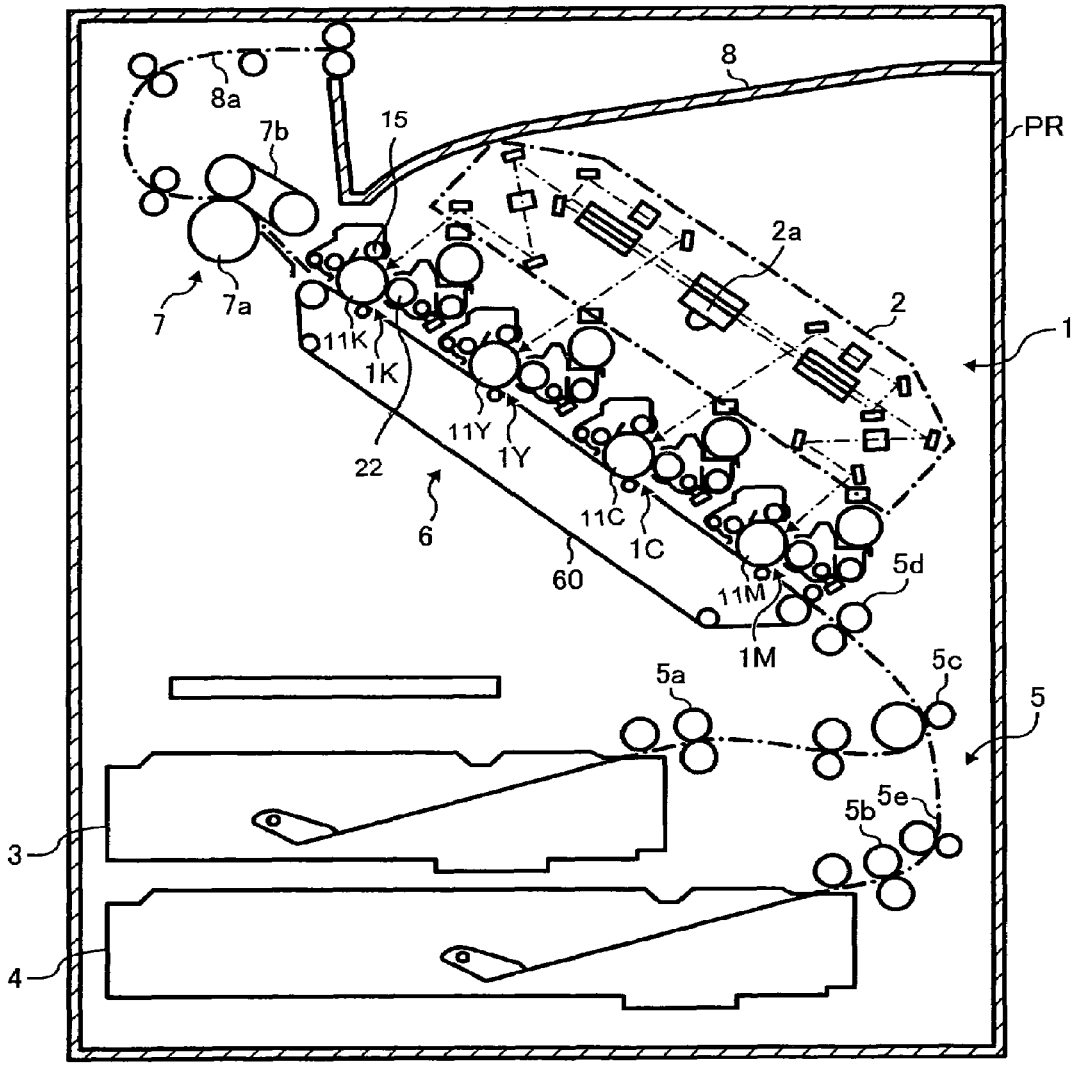
FIG. 2 is a schematic of the color printer.

FIG. 2 is a schematic configuration diagram of one example of a four-tandem type color printer as an image forming apparatus according to an embodiment of the invention. A color printer PR basically includes an image forming unit 1, an optical writing unit 2 as a latent image forming unit, paper trays 3 and 4 as first and second transfer member accommodating units, a paper feeder 5, a transfer unit 6, a fixing unit 7, and a paper discharging unit 8. The color printer PR forms an image on a sheet of recording paper as a recording member supplied from the paper tray 3 or 4 at a lower section, and discharges the recording paper to the paper discharging unit 8 at a higher section. The image forming unit 1 includes four image forming stations 1M, 1C, 1Y, and 1K. The first image forming station 1M forms an image with an M (Magenta) toner, the second image forming station 1C forms an image with a C (Cyan) toner, the third image forming station 1Y forms an image with a Y (Yellow) toner, and the fourth image forming station 1K forms an image with a K (Black) toner. Each of the image forming stations 1M, 1C, 1Y, and 1K is attachable to and detachable from the main body of the color printer PR, which facilitates maintenance such as replacement of parts constituting each image forming station 1M, 1C, 1Y, or 1K.

Figure 3:
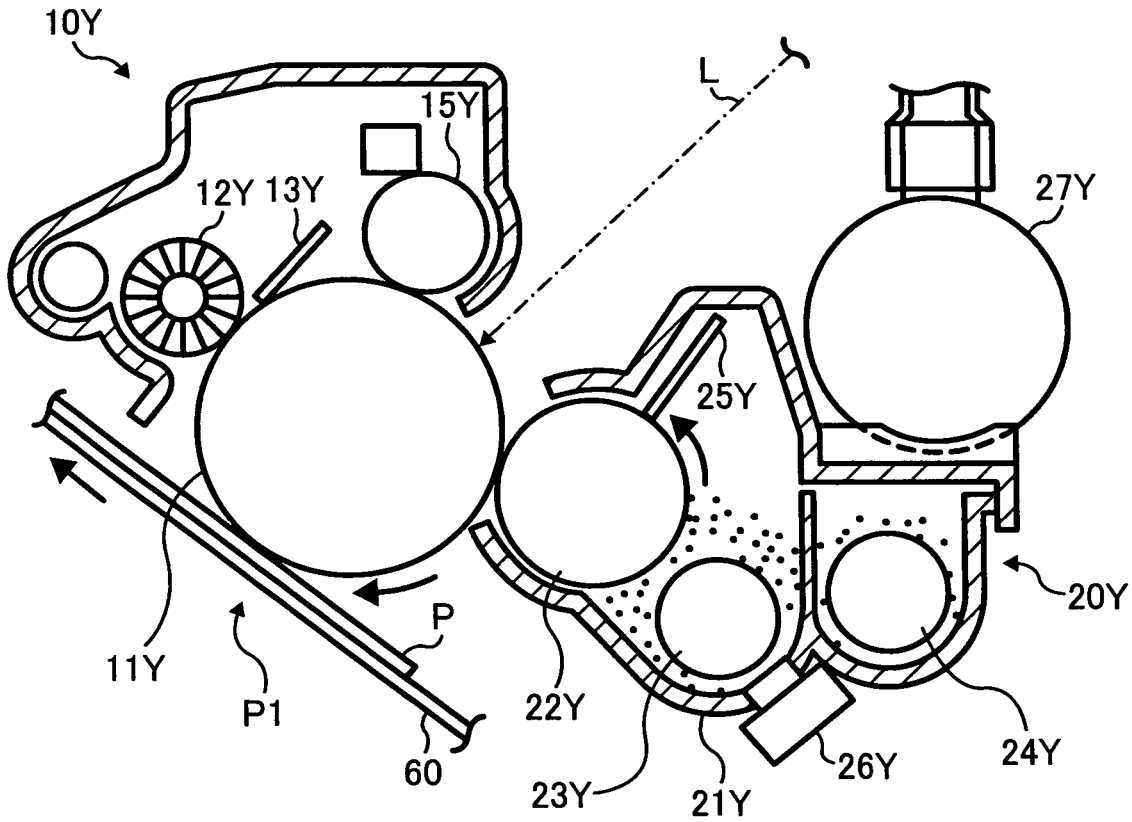
FIG. 3 is a detailed schematic of a third image forming station of the color printer.

FIG. 3 is a detailed configuration diagram of the third image forming station 1Y. The third image forming station 1Y has a charging/cleaning unit 10Y and a developing unit 20Y laid out around a photoconductor 11Y as an image carrier. A laser beam L for optical writing is irradiated onto the surface of the photoconductor 11Y from between the charging/cleaning unit 10Y and the developing unit 20Y.

The charging/cleaning unit 10Y has a charge roller 15Y as a uniform charging unit, and a cleaning brush 12Y and a scraping claw 13Y as a cleaning unit. The charge roller 15Y uniformly charges the surface of the photoconductor 11Y. The cleaning brush 12Y collects the residual toner on the photoconductor 11Y. The scraping claw 13Y scrapes off the toner that still remains on the photoconductor 11Y, thus making the surface of the photoconductor 11Y ready for next image formation.

The developing unit 20Y basically includes a developing roller 22Y as a developer carrier, an agitation roller 23Y, a feed roller 24Y, a doctor blade 25Y, a toner density sensor 26Y, and a toner bottle 27Y. These components are accommodated in a developer tank 21Y, or are provided at the developer tank 21Y. The toner that is supplied into the developer tank 21Y from the toner bottle 27Y is fed to the agitation roller 23Y while being agitated by the feed roller 24Y, and is further agitated by the agitation roller 23Y. Through the agitation, the toner is frictionally charged with a potential, and is fed to the developing roller 22Y. The toner having moved to the surface of the developing roller 22Y is restricted to a predetermined thickness by the doctor blade 25Y, and moves to a developing area facing the photoconductor 11Y according to the rotation of the developing roller 22Y. In the developing area, a latent image formed by optical writing is developed with the toner, yielding a toner image. The toner image formed on the surface of the photoconductor 11Y is transferred on a recording paper P, fed while being conveyed on an endless paper feeding belt 60 as a recording member feeding unit P1, in a transfer area facing the paper feeding belt 60. The toner that remains on the surface of the photoconductor 11Y is collected by the cleaning brush 12Y, and is removed off from the surface of the photoconductor 11Y by the scraping claw 13Y. The third image forming station 11Y shown in FIG. 3 has been explained, however, same explanation applies to the other image forming stations 1M, 1C, and 1K.

The optical writing unit 2 uses two polygon mirrors 2*a*, and has four optical write paths independently provided for the respective four colors. The optical writing unit 2 irradiates the laser beam L onto each photoconductor 11M, 11C, 11Y, or 11K from between the charge roller 15 and the developing roller 22 in each image forming station 1M, 1C, 1Y, or 1K, thereby performing optical writing.

The paper feeder 5 includes paper feed rollers 5*a* and 5*b* to pick up the recording papers P from the paper trays 3 and 4, respectively, a paper feed roller 5*c* provided along a paper feed path 5*e*, and a resist roller 5*d* as a resist rotary member provided in front of the image forming unit 1 at the upstream of the recording paper feed direction. The resist roller S*d* is driven at a given surface moving velocity (resist linear velocity) by a driver (not shown). According to the embodiment, the resist linear velocity can be changed by a controller (not shown) in the image forming apparatus, as a resist rotational velocity changing unit. The resist linear velocity is automatically changed after the set value of the resist linear velocity is acquired by the controller according to the embodiment. To manually change the set value of the resist linear velocity, a user operates ten keys or the like provided at the color printer PR as an input unit to input the desired set value. The controller as a setting unit changes the set value of the resist linear velocity according to the input set value. An external device, such as a personal computer (PC), can be connected to an external interface (input unit) of the color printer PR, so that a set value is input from the PC.

The resist roller 5*d* starts feeding the recording paper P at the timing when the leading end of the toner image formed on the photoconductor 11M of the first image forming station 1M enters the transfer area. The recording paper P fed out from the resist roller 5*d* is fed along with the surface movement of the paper feeding belt 60 while being adsorbed to the surface of the paper feeding belt 60. During the feeding, the toner images of the individual colors formed on the respective photoconductors 1M, 11C, 11Y, and 11K in the image forming stations 1M, 1C, 1Y, and 1K are sequentially transferred one on another. The recording paper P with the individual color toner images transferred thereon is fed to the fixing unit 7 for fixture. The fixing unit 7 is of a known type including a fixing rotary member 7*a* as a heat roller, and a fixing belt 7*b*. The fixed recording paper P is discharged onto a catch tray 8 through a discharge passage 8*a*.

Figure 4:
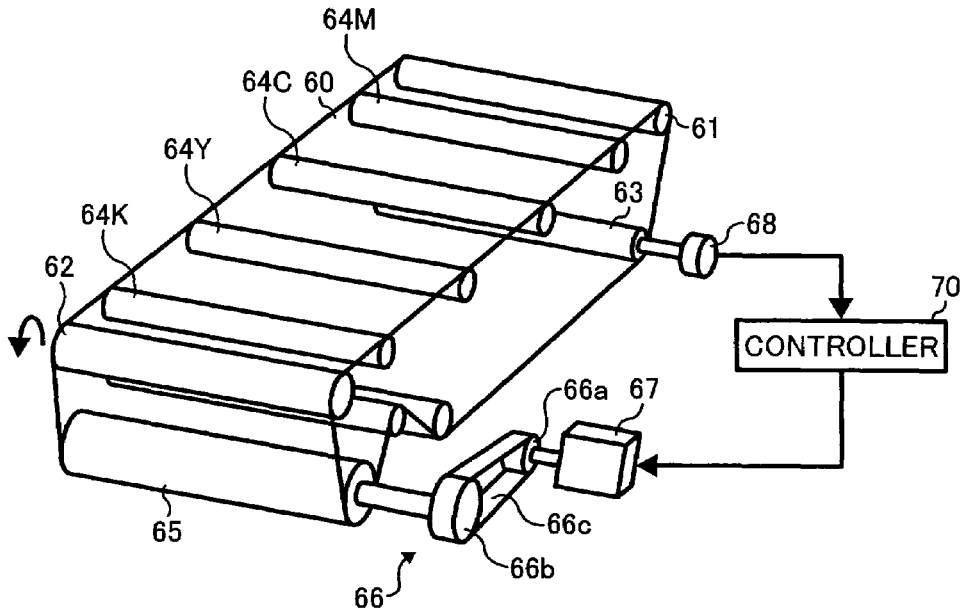
FIG. 4 is a perspective view of a drive system for a paper feeding belt of the color printer.

FIG. 4 is an explanatory diagram of a drive system for the paper feeding belt 60. For the sake of descriptive convenience, the paper feeding belt 60 is shown transparently. The paper feeding belt 60 is stretched across an inlet roller 61 on the recording paper feed-in side, an outlet roller 62 on the discharge side, a lower right driven roller 63, a drive roller 65, and the like. The inlet roller 61, the outlet roller 62, and the lower right driven roller 63 among the rollers are driven rollers which rotate with the movement of the paper feeding belt 60. The drive roller 65 is connected to a pulse drive motor 67 as a drive source via a deceleration mechanism 66 constituting the drive power transmission system. The deceleration mechanism 66 includes a drive belt 66*c* stretched between a small pulley 66*a* and a large pulley 66*b*. In this embodiment, the drive roller 65, the deceleration mechanism 66 and the pulse drive motor 67 constitute a drive-roller driver that drives the paper feeding belt 60. An adsorption roller (not shown) for charging the recording paper and adsorbing the recording paper to the paper feeding belt 60 is provided on a side of the inlet roller 61 where the photoconductor 11 of the inlet roller 61 is laid out. The adsorption roller is connected to a bias power supply to be applied with a predetermined charge. The recording paper fed out from the resist roller 5*d* is fed to a nip portion between the inlet roller 61 and the adsorption roller, is charged in the manner mentioned above, and is then adsorbed onto the paper feeding belt 60. The recording paper P is then fed to the first image forming station 1M along with the surface movement of the paper feeding belt 60.

Transfer rollers 64M, 64C, 64Y, and 64K as a transfer unit are provided at the inner peripheral surface of the paper feeding belt 60 facing the photoconductors 11M, 11C, 11Y, and 11K of the respective image forming stations 1M, 1C, 1Y, and 1K. A transfer bias voltage is applied to the transfer rollers 64M, 64C, 64Y, and 64K. Accordingly, transfer electric fields are formed in the respective transfer areas, and individual color toner images are transferred on the recording paper P fed while being adsorbed onto the paper feeding belt 60. A cleaning roller (not shown) is disposed facing the outlet roller 62 at a belt portion at the downstream of the paper feeding belt 60 in the moving direction of the belt and at the upstream of the inlet roller 61. As the bias from the bias power supply is applied to the cleaning roller, the toner adhered to the surface of the paper feeding belt 60 is removed.

The pulse drive motor 67 can be subjected to feedback control by a controller 70 so as to be driven at a drive velocity according to a predetermined target value. Therefore, the surface moving velocity (belt moving velocity) of the paper feeding belt 60 is kept substantially constant to the desired velocity (e.g., 125 mm/sec) while suppressing a fluctuation in velocity originating from a transmission error of the drive transmission system (fluctuation per one rotation of the drive belt or a fluctuation caused by eccentricity of the drive roller).

Specifically, according to the embodiment, a rotary encoder 68 as a rotation detector is provided at the lower right driven roller 63 serving as a driven roller. The output of the rotary encoder 68 is sent to the controller 70 as a feedback controller. The belt moving velocity of the paper feeding belt 60 can be grasped based on the output of the rotary encoder 68. The controller 70 compares the output value of the rotary encoder 68 with the target value of the paper feeding belt 60, and outputs a drive pulse to the pulse drive motor 67 so as to cancel the difference between the compared values. In this embodiment, the feedback control is executed every 1 millisecond.

Figure 5:
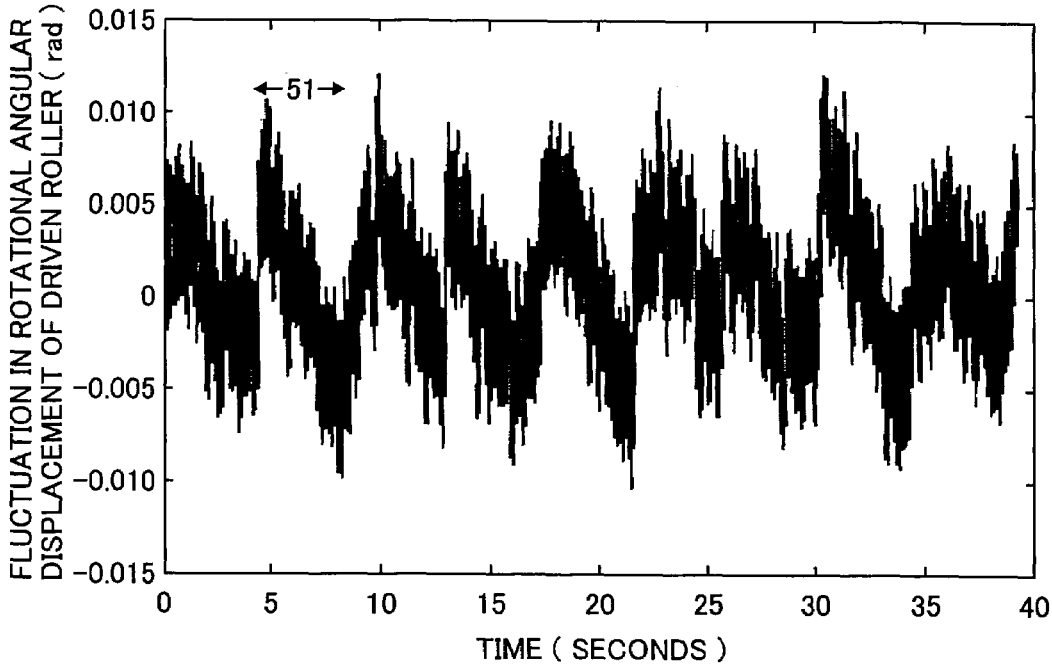
FIG. 5 is a graph depicting fluctuation in a rotational velocity of a driven roller when a moving velocity of a peripheral surface of the resist roller. (resist linear velocity) is set slower than a moving velocity of the paper feeding belt.

FIG. 5 depicts a fluctuation in the rotational angular change of the driven roller when the resist linear velocity (the moving velocity of the peripheral surface of the resist roller) is set slower than the moving velocity of the paper feeding belt 60 if the rotational velocity of the fixing rotary member is set adequately. The data in FIG. 5 is acquired from the output of the rotary encoder 68 when the pulse drive motor 67 shown in FIG. 4 is driven by a predetermined drive pulse corresponding to the target average velocity without performing feedback control, and recording paper of size A3 is continuously fed to the paper feeding belt 60 from the resist roller 5*d*. Specifically, the pulses output from the rotary encoder 68 according to the rotation of the lower right driven roller 63 as a driven roller are counted, and the deviation from the target rotational angular change is plotted. The fluctuation in the rotational angular change of the driven roller on the vertical axis in FIG. 5 indicates the deviation from the target rotational angular change. The change on the positive side shows a state where the roller rotates more than the target rotational angular change, and the change on the negative side shows that the target rotational angular change is not reached yet. The range indicated by an arrow 51 shown in FIG. 5 indicates a time zone where the recording paper of size A3 is in contact with both the resist roller 5*d* and the paper feeding belt 60. The time zone is predicted from the drive timing for the resist roller. More specifically, a paper sensor as a recording member detector can be provided near the resist roller 5*d*, and the time zone can be predicted from the timing when the leading end or the trailing end of the recording paper passes. As the resist linear velocity is slower than the moving velocity of the paper feeding belt 60, the resist roller 5*d* works to pull the recording paper in the direction opposite to the moving direction of the paper feeding belt 60 while the recording paper is in contact with both the resist roller 5*d* and the paper feeding belt 60. Accordingly, the feeding velocity of the paper feeding belt 60 or a change in the rotational angle of the driven roller decreases or changes in the negative direction. This phenomenon occurs every time the recording paper of size A3 passes.

In the color printer according to the embodiment, the rotational angular velocity of the driven roller 63 or a fluctuation in the rotational angular change (the feeding velocity of the paper feeding belt 60 or a change in the amount of movement thereof) at the time of passage of the recording paper is recognized as the average rotational angular velocity or a fluctuation in rotational angle in the zone, and the resist linear velocity (fixing linear velocity, paper feeding belt moving velocity) is adjusted. The adjustment suppresses a fluctuation in the rotational velocity of the paper feeding belt 60, and achieves high precision image formation.

Figure 6:
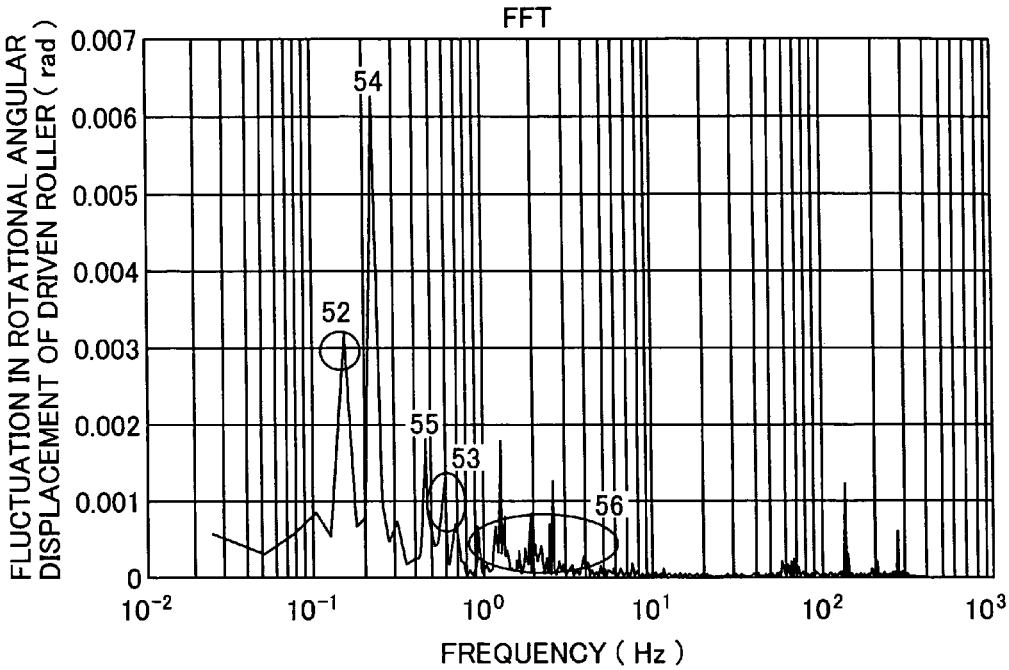
FIG. 6 is a graph depicting results of frequency analysis on data of the fluctuation in the rotational velocity of the driven roller shown in FIG. 5.

FIG. 6 depicts the results of frequency analysis on data of the fluctuation in the rotational velocity of the driven roller shown in FIG. 5. A fluctuation indicated by a reference numeral 52 in FIG. 6 occurs in the rotational period of the paper feeding belt 60. This is because the paper feeding belt 60 has a thickness deviation distribution in the circumferential direction. This originates from the fact that when a thick portion of the paper feeding belt 60 is wound around the drive roller 65, the rotational angular velocity of the driven roller 63 (feeding velocity of the paper feeding belt 60) increases, whereas when a thin portion of the paper feeding belt 60 is wound around the drive roller 65, the rotational angular velocity of the driven roller 63 (feeding velocity of the paper feeding belt 60) decreases. A fluctuation indicated by a reference numeral 53 in FIG. 6 occurs in the rotational period of the drive belt 66*c* due to a transmission error caused by a fluctuation or the like in the position of the core of the drive belt 66*c*. A fluctuation indicated by a reference numeral 54 in FIG. 6 occurs in the paper passage period for the transfer paper of size A3, and a fluctuation indicated by a reference numeral 55 shows the secondary component of the fluctuation 54. A fluctuation indicated by a reference numeral 56 in FIG. 6 occurs due to an error in other components of the drive transmission system, such as a motor shaft gear, a drive roller, and a drive roller shaft gear.

Figure 7:
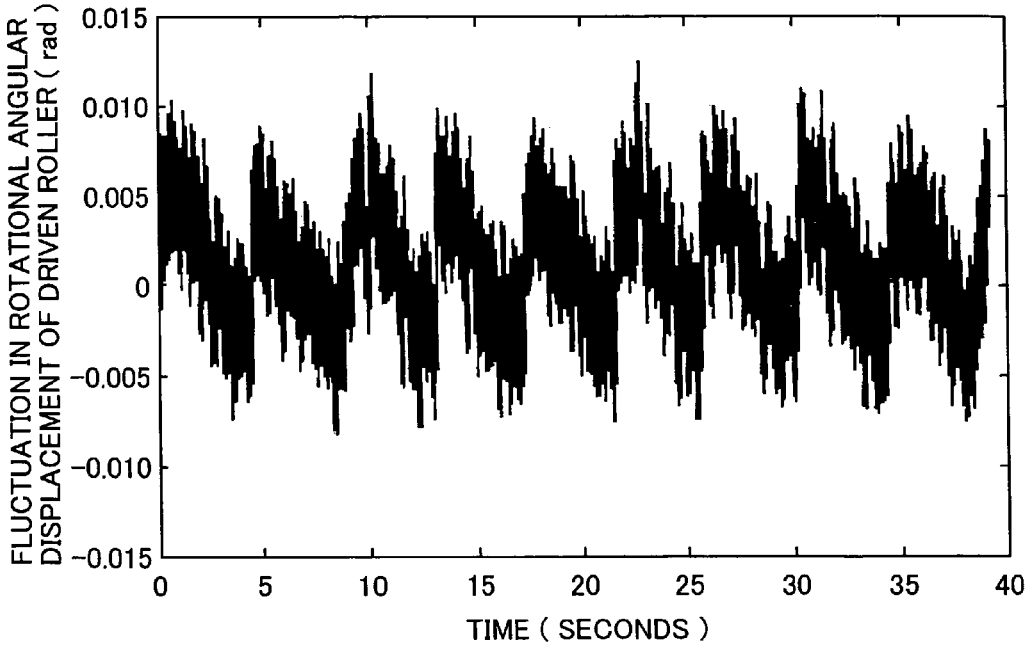
FIG. 7 is a graph depicting results of eliminating a fluctuation component, which is generated in the rotational periods of the paper feeding belt and the drive belt, from the data shown in FIG. 5.

The color printer according to the embodiment requires accurate detection of a fluctuation occurring when the recording paper passes as indicated by the reference numerals 54 and 55 in FIG. 6. However, data which is actually detected by the rotary encoder 68 includes various fluctuation components as mentioned above, and cannot be detected accurately. Therefore, the amplitude and the phase of a fluctuation component occurring in the rotational period of the paper feeding belt 60 are calculated through frequency analysis on data as shown in FIG. 5, detected by the rotary encoder 68. Then, a sine function is calculated from the amplitude and the phase of the fluctuation component to yield a numerical value, which is subtracted from the data in FIG. 5 to cancel the fluctuation occurring in the rotational period of the paper feeding belt 60. Similarly, a fluctuation occurring in the rotational period of the drive belt 66*c* can be eliminated. FIG. 7 depicts the result of eliminating from the data in FIG. 5, the fluctuation components occurring in the rotational periods of the paper feeding belt 60 and the drive belt 66*c*. This can ensure accurate adjustment of the linear velocity. The fluctuation indicated by the reference numeral 56 in FIG. 6, which has a relatively high frequency, can be eliminated by smoothing using the moving average process on data for the rotational period.

Although a scheme of detecting a fluctuation component in the belt rotational period from the data in FIG. 5, and eliminating the fluctuation component has been explained above, a scheme of a higher accuracy can be used. A belt home position mark (not shown) as a mark member is provided at any position on the paper feeding belt 60 shown in FIG. 4, and a mark sensor (not shown) as a detector (not shown), that detects passing of the mark, is provided. The amplitude of the fluctuation in the belt rotational period and a phase with the belt home position taken as a reference are detected from the output data of the rotary encoder 68 when the pulse drive motor 67 is driven by a steady drive pulse to rotate the paper feeding belt 60 by one turn or more without feeding the recording paper P. The belt home position is also detected at the time of acquiring the data in FIG. 5, or acquisition of the data is initiated triggered by the belt home position. The rotational displacement that is calculated from the amplitude and the phase of the change in the belt rotational period detected previously is subtracted from the data detected currently in synchronism therewith. Accordingly, the change in belt rotational period can be eliminated from the data in FIG. 5. Since the scheme of predetecting the amplitude and the phase of the change in belt rotational period without passing the recording paper involves less disturbance when the recording paper passes, more accurate detection of a fluctuation in the belt rotational period can be ensured. A similar process can be applied to the drive belt 66*c*.

Figure 8:
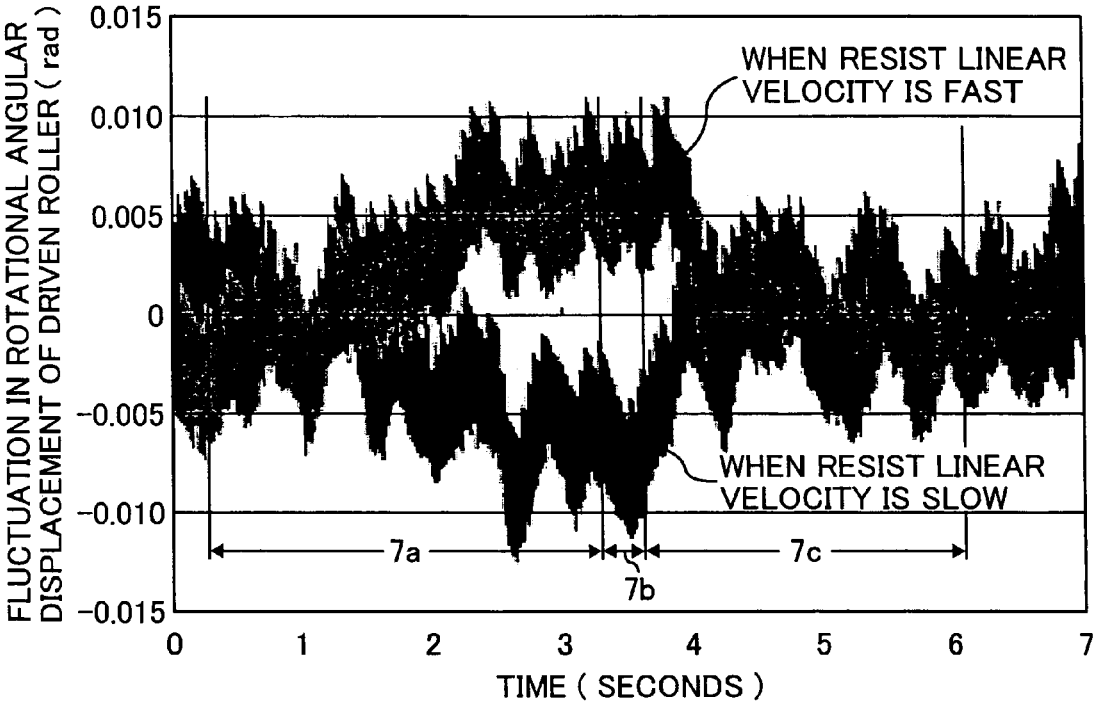
FIG. 8 is a graph depicting a fluctuation in the rotational velocity of the driven roller acquired from an output of an encoder when a pulse drive motor is driven by a steady drive pulse and a single piece of recording paper is fed.

FIG. 8, similarly to FIG. 5, shows data output from the encoder 68 when the pulse drive motor 67 is driven by a steady drive pulse to feed a single piece of recording paper. As mentioned above, the process of eliminating a fluctuation in a belt rotational period is carried out. FIG. 8 depicts (1) a fluctuation when the linear velocity of the resist roller 5*d* is set faster than the moving velocity of the paper feeding belt 60, and (2) a fluctuation when the linear velocity of the resist roller 5*d* is set slower. In FIG. 8, a zone 7*a* is a time zone where the recording paper is in contact with the resist roller 5*d* and the paper feeding belt 60, a zone 7*b* is a time zone where the recording paper is in contact only with the paper feeding belt 60, and a zone 7*c* is a time zone where the recording paper is in contact with the paper feeding belt 60 and the fixing rotary member.

Figure 9:
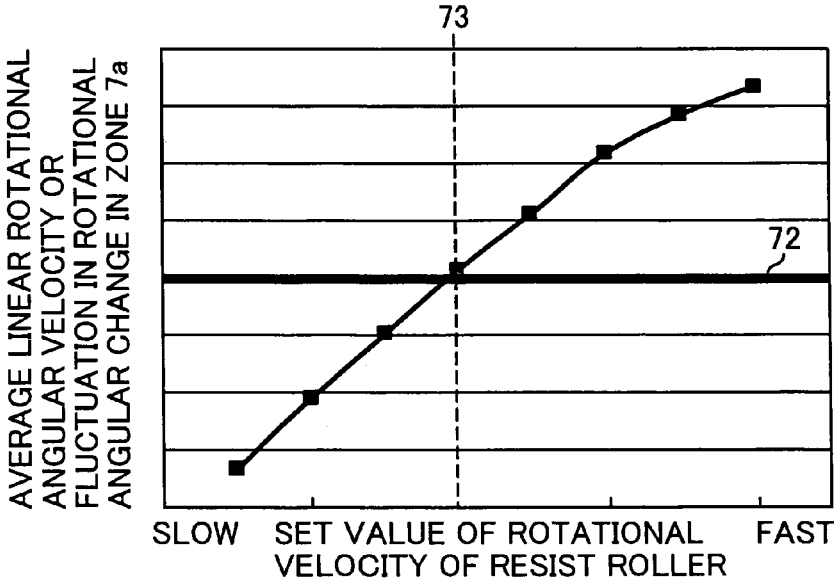
FIG. 9 is a graph of plotted rotational information of the driven roller (an average rotational angular velocity or a fluctuation in the rotational angular change) over a zone 7*a* shown in FIG. 8, acquired by measuring an output of the encoder with respect to eight different settings of resist linear velocities.

The average linear velocity or the amount of the positional change over the zone 7*a* is acquired as a fluctuation in the zone 7*a*. The average linear velocity is calculated from the inclination of the approximation line acquired from the least square of data in the zone 7*a*. The fluctuation of a rotational angular change becomes the value of a fluctuation in the zone 7*a* (about 0.0075 radian for the data in the case (1) shown in FIG. 8). When there is a large fluctuation in the drive transmission system, the average linear velocity or the positional change should be acquired using zone data which is an integer multiple of the rotational period of the drive transmission system over the zone 7*a*. This provides a value which is less influenced by the fluctuation in the drive transmission system. FIG. 9 is a graph of the plot of the average rotational angular velocity or the fluctuation in rotational angular change over the zone 7*a*, acquired by measuring the output of a similar encoder 68 with respect to eight different setting types of resist linear velocities. The vertical axis and the horizontal axis in FIG. 9 can be of any unit system. For example, for the average rotational angular velocity, the pulse count value is directly used as the number of counts per unit time. The fluctuation in rotational angular change can be used as the number of counts itself. The horizontal axis can show a ratio to the instruction value for the resist drive motor or the reference velocity of the motor. Regardless of the unit system of the vertical axis and the horizontal axis, a graph showing a similar tendency is acquired.

A line indicated by a reference numeral 72 in FIG. 9 indicates the average rotational angular velocity or the fluctuation in rotational angular change when the recording paper P is not in contact with both the resist roller 5*d* and the paper feeding belt 60. That is, the line shows a numerical value when the paper feeding belt 60 is not influenced by the difference in resist linear velocity via the recording paper P. The value can be measured with the belt driven before the recording paper P is fed for the measurement. It is desirable to set the resist linear velocity so that the average linear velocity of the paper feeding belt 60 does not fluctuate or the positional change does not occur between when the paper feeding belt 60 is driven alone and when the recording paper is fed to the paper feeding belt 60 from the resist roller 5*d*. It is apparent from the result of setting the eight types of resist linear velocities shown in FIG. 9 and feeding the paper, that the set value of the rotational velocity of the resist roller (the set value of the resist linear velocity) indicated by a dot line 73 holds the optimal values. The resist linear velocity can be adjusted this way.

Figure 10:
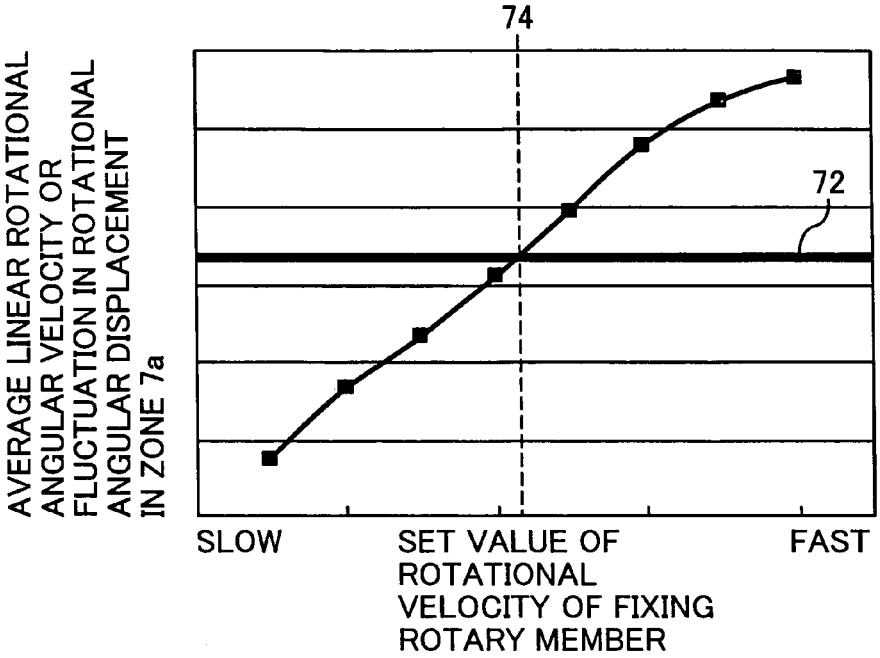
FIG. 10 is a graph of plotted rotational information of the driven roller (the average rotational angular velocity or a fluctuation in the rotational angular change) over the zone 7*a* shown in FIG. 8, acquired by measuring the output of the encoder with respect to eight different settings of linear velocities of a fixing rotary member.

In FIG. 9, when the average linear velocity or the amount of the positional change on the positive side to the line 72 showing a numerical value when the paper feeding belt 60 is driven alone without being influenced by the difference in resist linear velocity via the recording paper is detected, the resist linear velocity is apparently faster than the adequate velocity. On the contrary, when the average linear velocity or the amount of the positional change is on the negative side, the resist linear velocity is apparently slower than the adequate velocity.

similarly, it is possible to acquire data in FIG. 10 from a fluctuation over the zone 7*c* with recording paper being fed at a plurality of linear velocities set for the fixing rotary member, and to set the linear velocity of the fixing rotary member to a value on a dot line 74.

When the characteristics shown in FIGS. 9 and 10 have substantial linearity, it is possible to acquire an adequate set value by setting two types of linear velocities for the resist roller and two types of linear velocities for the fixing rotary member, and performing linear interpolation.

Desirably, the recording paper to be fed has paper fibers aligned in the feed direction because a hard recording paper (having higher rigidity in the feed direction) has a linear characteristic as shown in FIGS. 9 and 10. Even when the resist linear velocity is set fast, for example, if the recording paper is soft and is flexed, a difference in velocity is absorbed, resulting in a small increase in average linear velocity of the paper feeding belt 60 or a small amount of the positional change and yielding a saturated characteristic. When linear interpolation is performed to acquire the set value, therefore, an error can occur. It is better for the adhesion between the recording paper and the paper feeding belt 60 to be high. This is because if slippage occurs between the recording paper and the paper feeding belt 60, the characteristics shown in FIGS. 9 and 10 are difficult to obtain. In this case, it is better to use the recording paper that has passed the fixture unit once. The water content in the recording paper that passes the fixture unit is evaporated by the heat from the fixing unit, reducing the amount of water content. As a result, the volume resistance of the recording paper increases, thereby improving the adhesion to the belt. It is better to use a recording paper having passed the fixing unit once in the image forming apparatus having a path of feeding the recording paper again to the image forming unit after an image is formed on one side of the recording paper.

By using a similar scheme, it is possible to fix the resist linear velocity to a certain value, set a plurality of linear velocities for the paper feeding belt, and adjust the linear velocity of the paper feeding belt 60 to the resist linear velocity based on the result of feeding the recording paper under the condition. In this case, the horizontal axis in the graphs in FIGS. 9 and 10 represents the set value of the linear velocity of the paper feeding belt, and the vertical axis represents the amount of the positional change over the zone 7*a*.

The zone 7*b* shown in FIG. 8 shows the time zone over which the trailing end of the recording paper passes the resist roller and the recording paper is in contact only with the paper feeding belt 60. In this zone, a rapid change occurs. This change is originated from a fluctuation in the tension of the paper feeding belt 60 or the stretching or contraction of the belt. When the resist roller is set fast and the recording paper is nipped at the resist roller to push the paper feeding belt 60, for example, the belt tension from that belt portion with which the recording paper is in contact to the drive roller in the belt feed direction drops, while the belt tension from that belt portion with which the recording paper is in contact to the drive roller in the opposite direction to the belt feed direction increases. There is a difference between the belt tensions in two zones. As a result, the position of the tension roller changes according to the stretching or the contraction of the belt and a change in the tension. When the trailing end of the recording paper passes through the resist roller, the tension difference is eliminated and the tension returns to the original state. At the same time when stretching or contraction of the belt occurs in the direction of returning to the original state, the tension roller returns to the original position, resulting in a change in the position of the belt.

Figure 11:
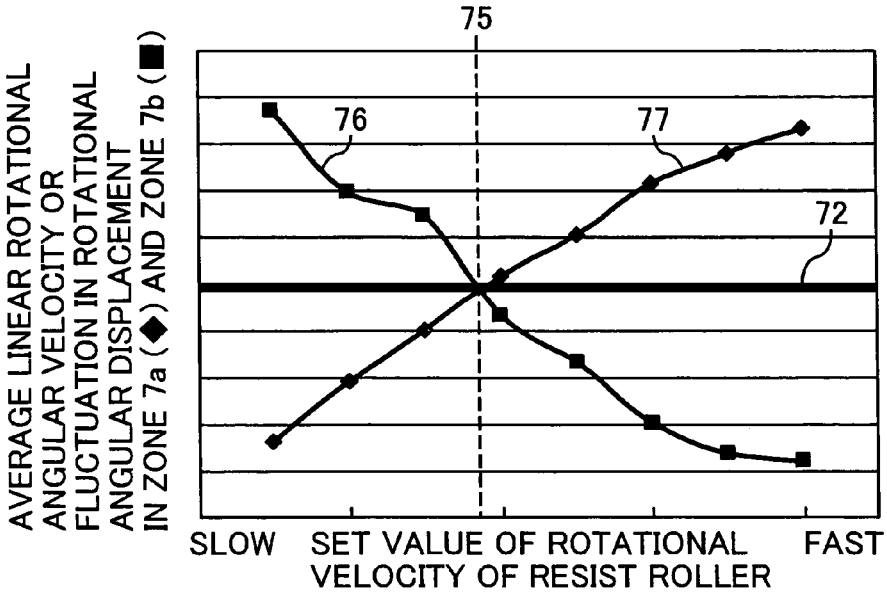
FIG. 11 is a graph of the result of measuring a fluctuation in rotational velocity over a zone 7*b* shown in FIG. 8 in the same way as done for the value of the rotational velocity over the zone 7*a;*

FIG. 11 depicts the result of measuring the fluctuation in rotational velocity over the zone 7*b* shown in FIG. 8 in the same way as done for the value of the rotational velocity over the zone 7*a*. A plot 76 in FIG. 11 shows the fluctuation over the zone 7*b*, and shows that the optimal set value of the resist linear velocity can likewise be acquired. The optimal set value of the linear velocity of the fixing rotary member can likewise be acquired by detecting a fluctuation occurring after the zone 7*c* shown in FIG. 8.

Reference numeral 77 in FIG. 11 shows the graph in FIG. 9 showing the plotted values of the fluctuation over the zone 7*a*. An intersection 75 with the plot 76 can be taken as the optimal value of the resist linear velocity. Since the optimal value is acquired from greater pieces of data than is done in the setting method discussed previously, the precision is higher.

According to the color printer of the embodiment, the controller 70 can perform feedback control on the rotation of the pulse drive motor 67 so that the paper feeding belt 60 takes a constant moving velocity based on the output of the rotary encoder 68. During such feedback control, the output of the encoder 68 is controlled to the constant target value, so that the characteristic as shown in FIG. 9 cannot be acquired from the encoder output. The characteristic as shown in FIG. 9 can be acquired by supplying a control signal to the pulse drive motor (a pulse input to the motor) or detecting the rotation of the drive motor. That is, while feedback control is executed, the control signal is sent to the pulse drive motor so as to cancel out a fluctuation shown in FIG. 8, and the drive motor rotates accordingly. In this respect, the control signal to the drive motor and the fluctuation in the rotation of the drive motor provide fluctuation data having the opposite characteristic to the characteristic of the fluctuation shown in FIG. 8. A characteristic whose inclination is opposite to the inclination of the characteristic shown in FIG. 9 is acquired by detecting the average value or the fluctuation over each zone 7*a*, 7*b*, or 7*c* from the fluctuation data as done for the fluctuation data shown in FIG. 8. However, the optimal resist linear velocity and the optimal fixing linear velocity can be set by comparing the rotation of the pulse drive motor or the fluctuation data of the control signal in this case with the rotation of the pulse drive motor when the paper feeding belt 60 is driven alone or the fluctuation data of the control signal (equivalent to the line 72 shown in FIG. 9).

The procedures for adjusting the linear velocity of the resist roller and the linear velocity of the fixing rotary member in the color printer according to the embodiment are described specifically.

Figure 1:
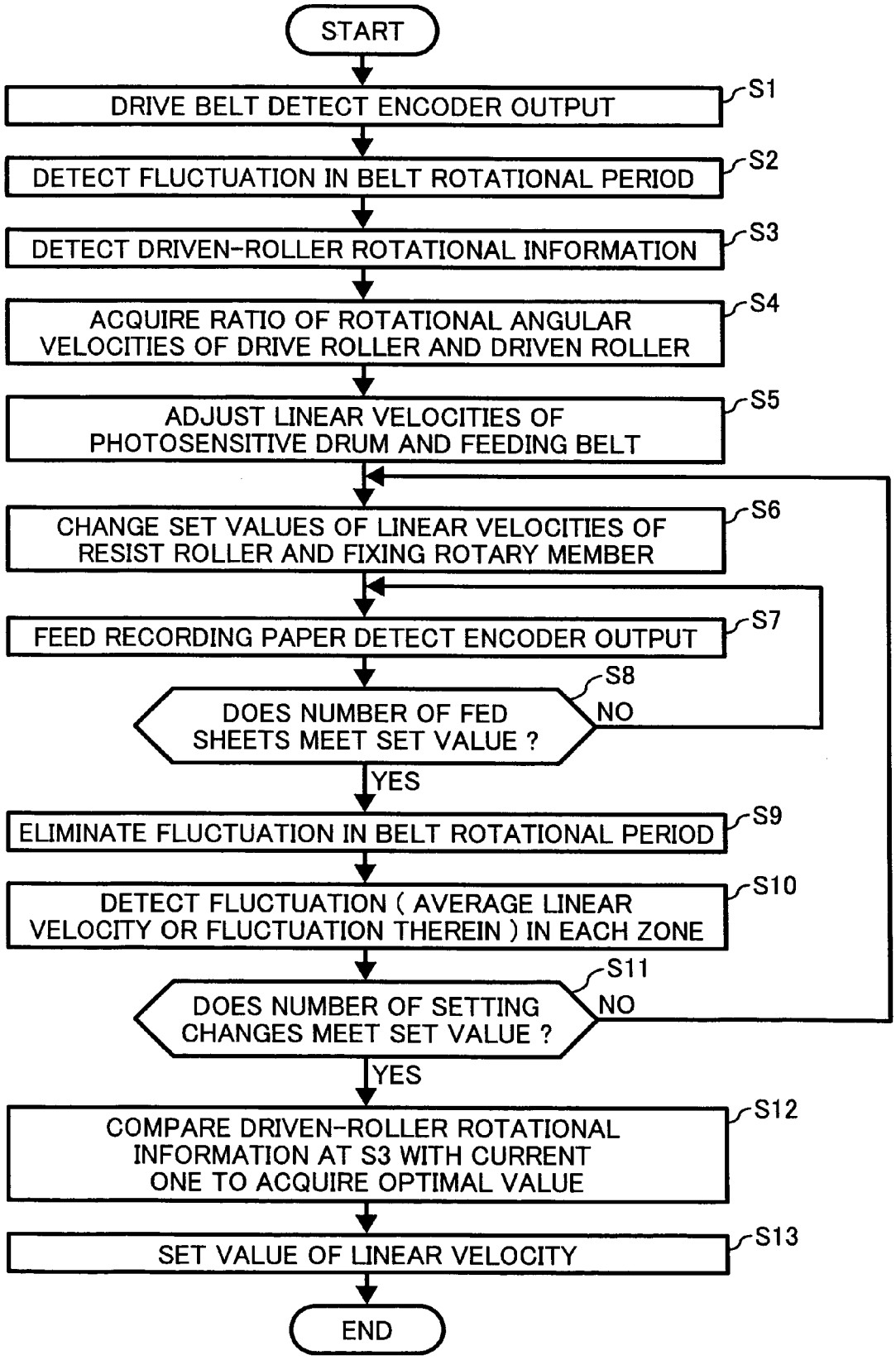
FIG. 1 is a flowchart of a procedure for adjusting a rotational velocity of a resist roller in a four-tandem type color printer as an image forming apparatus according to an embodiment of the present invention.

FIG. 1 is a flowchart of one example of a procedure for adjusting the linear velocity of the resist roller and the linear velocity of the fixing rotary member.

The procedure in the flowchart shown in FIG. 1 is executed in the manufacture process before the user uses the image forming apparatus according to the embodiment. Therefore, the user can actually use the image forming apparatus with an optimally adjusted linear velocity. The procedure in the flowchart is also executed when any of the paper feeding belt unit, the fixing unit, and the resist roller is replaced. When such replacement takes place, the diameter of the drive roller or the thickness of the paper feeding belt may differ due to a difference in the precision of parts, resulting in a change in feeding velocity, or the diameter of the resist roller may differ, changing the feeding velocity of the recording paper fed out from the resist roller, or the feeding velocity of the recording paper at the fixing rotary member can also change. Therefore, adjustment of those linear velocities is carried out again to keep the linear velocity of the resist roller and the linear velocity of the fixing rotary member set at the optimal linear velocities.

The pulse drive motor 67 is driven by the steady drive pulse to turn the paper feeding belt 60 by one turn or more (S1). The amplitude of the fluctuation in the belt rotational period and the phase with the belt home position taken as a reference are detected from the output data of the encoder 68 (S2). The driven-roller rotational information that is not influenced by the resist linear velocity that provides the line 72 in FIG. 9 and the linear velocity of the fixing rotary member (the average rotational angular velocity of the driven roller 63 or the amount of the rotational angular change) is detected (S3). The ratio of the diameter of the drive roller 65 to the diameter of the lower right driven roller 63 is acquired from the ratio of the average rotational angular velocity of the drive roller, which is predicted from the drive pulse of the pulse drive motor, to the average rotational angular velocity of the lower right driven roller 63, which is detected from the output of the encoder 68 (S4). This is performed to accurately acquire the ratio of the diameters of the two rollers in each belt unit which differ from each other due to a difference in the precision of parts, and to match the feeding velocity of the paper feeding belt 60 when the feedback control is enabled and disabled. With the feedback control enabled, the paper feeding belt 60 is driven so as to make the rotational angular velocity of the lower right driven roller 63 constant, whereas with the feedback control disabled, the paper feeding belt 60 is driven with the rotational angular velocity of the drive roller 65 set constant. If the ratio of the diameters of the drive roller 65 and the lower right driven roller 63 has not been obtained accurately, it is not possible to match the feeding velocity of the paper feeding belt 60 under the enabled feedback control with the feeding velocity of the paper feeding belt 60 under the disabled feedback control. Matching the belt feeding velocity under the enabled feedback control with the belt feeding velocity under the disabled feedback control eliminates the need for adjusting the linear velocities of the resist and the fixing rotary member in each of the feedback control enabled mode and the feedback control disabled mode. Therefore, the adjustment need only be performed in one of the modes.

The linear velocity of the photoconductor in contact with the paper feeding belt 60 is adjusted (S5). Here, the photosensitive drum is driven to form a test pattern on the paper feeding belt 60, and the width of the test pattern in the feed direction of the belt is detected using a charge coupled device (CCD) sensor (not shown). If the difference between the linear velocity of the photosensitive drum and the linear velocity of the paper feeding belt 60 is large, the test pattern is stretched, making the width of the pattern wider. Whether the test pattern is formed with a proper width is detected, and the average velocity of the photosensitive drum or the paper feeding belt 60 is adjusted if needed. After adjustment, the resist linear velocity and the linear velocity of the fixing rotary member are adjusted with the linear velocity of the paper feeding belt 60 taken as a reference. Accordingly, the feeding velocity of the recording paper in every image forming unit according to the embodiment is set optimally.

The flow proceeds to an operation of acquiring the optimal set values of the linear velocities of the resist roller and the fixing rotary member from a fluctuation in the linear velocity of the paper feeding belt 60 when plural linear velocities are set for the resist roller and the fixing rotary member.

Each of the set values of the rotational velocities of the resist roller and the fixing rotary member is changed to one of the set values of the respective resist roller or the fixing rotary member (S6). Next, the recording paper is fed and the output of the encoder 68 is measured (S7).

A random fluctuation component originating from slippage or the like occurring between the drive roller and the paper feeding belt 60 and between the paper feeding belt 60 and the recording paper is eliminated, plural sheets of recording paper can be continuously fed, and data at the paper feeding times can be averaged to improve the measurement precision (S8).

Thereafter, a process of removing a fluctuation in the rotational period of the belt is executed based on the data detected at step S2 (S9). A process of removing a fluctuation in the rotational period of the drive transmission system is also executed.

Driven-roller rotational information (average rotational angular velocity or the amount of the rotational angular change of the driven roller 63) in each zone shown in FIG. 9 is detected (S10). The operations at S6 to S10 are repeated according to the number of settings of linear velocities (S11).

The optimal set values of the rotational velocities (linear velocities) of the resist roller 5*d* and the fixing rotary member are acquired from the characteristic obtained as shown in FIG. 9 or FIG. 10 (S12).

The rotational velocities (linear velocities) of the resist roller 5*d* and the fixing rotary member can be set for each of plural types of recording paper of different thicknesses. Since the amount of deformation of a rubber layer at the surface of the resist roller 5*d* changes according to the thickness of the recording paper, for example, the feeding velocity of the recording paper can change. To cope with such a change originating from the thickness of the recording paper, three types of recording paper of different thicknesses are generally used to adjust the rotational velocities (linear velocities) of the resist roller 5*d* and the fixing rotary member. The optimal set values of the rotational velocities (linear velocities) acquired by the adjustment are stored in the image forming apparatus for each paper thickness. The user reads out the optimal set values which are stored according to the type of paper to be used and are to be notified to the image forming apparatus when in use, and sets the values in the controller (S13).

Alternatively, as to how much the feed velocities of the resist roller 5*d* and the fixing rotary member change according to the thickness of the recording paper can be grasped beforehand, linear velocity adjustment is carried out using one type of recording paper having a certain thickness, and setting of the linear velocities corresponding to the other thicknesses can be offset. For example, the set value of the linear velocity of the resist roller 5*d* when recording paper with a thickness of 0.1 millimeter is used is increased by 0.1% with respect to the result of adjusting the linear velocity of the resist roller 5*d* using a recording paper with a thickness of 0.2 millimeter.

Figure 12:
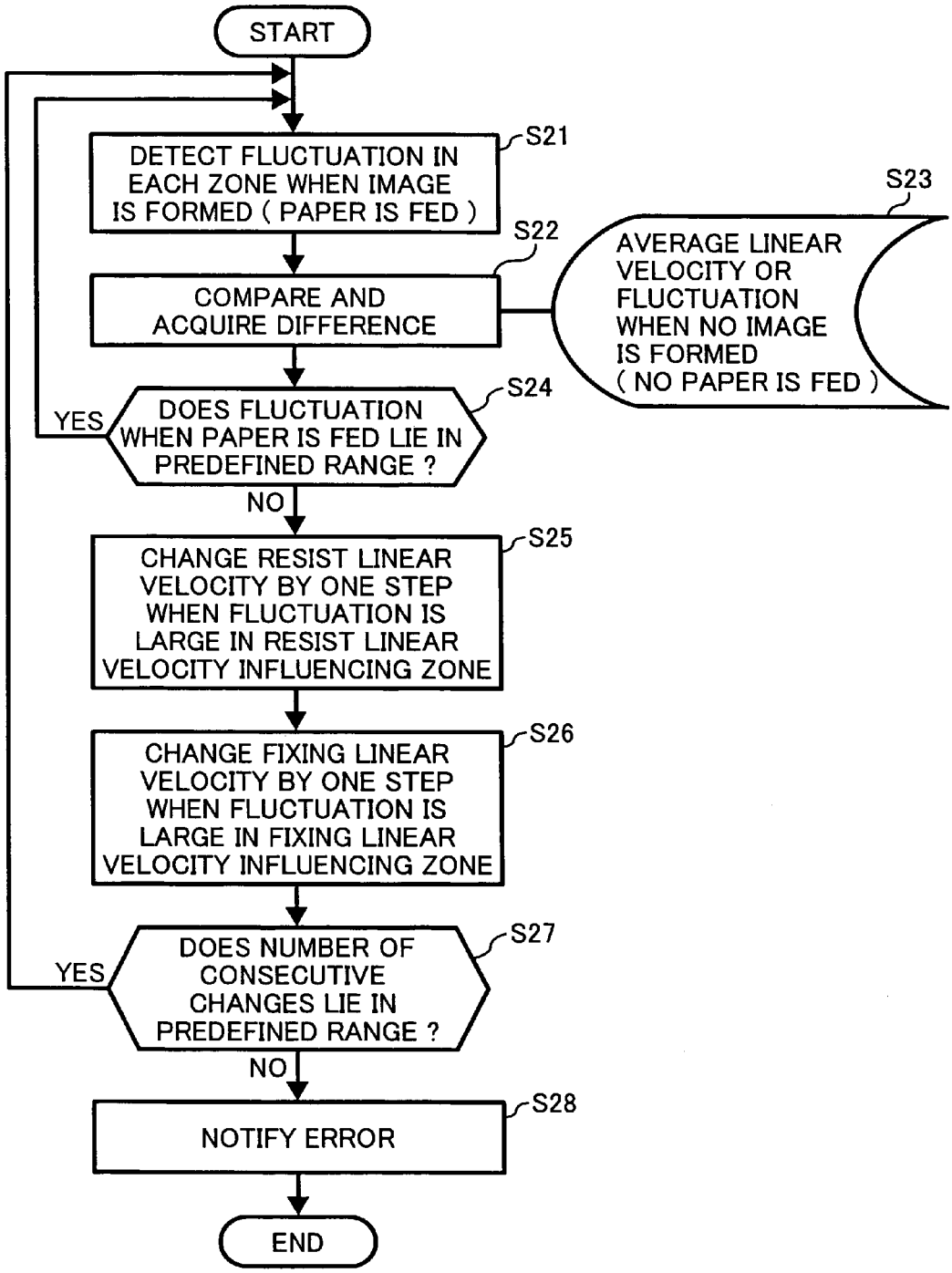
FIG. 12 is a flowchart of a procedure for adjusting the linear velocity of the resist roller and the linear velocity of the fixing rotary member, which is executed whenever necessary even when a user operates a printer to form an image in the market.

FIG. 12 is a flowchart of one example of a procedure for adjusting the linear velocity of the resist roller and the linear velocity of the fixing rotary member, which is executed whenever necessary even when a user operates the printer to form an image in the market.

A method of adjusting the linear velocity of the fixing rotary member which is executed whenever necessary even when the user operates the printer to form an image in the market, is explained. First, driven-roller rotational information (average rotational angular velocity or the amount of the rotational angular change of the driven roller 63) in each zone shown in FIG. 9 is detected even when image is being forming (S21). This operation corresponds to the operations at S6 to S10 in FIG. 1. The detected driven-roller rotational information is compared with the driven-roller rotational information with no paper fed out (S23), which has been measured and stored beforehand (S22), and it is determined whether the former driven-roller rotational information lies in a predefined range (S24). When the detected driven-roller rotational information lies in the range, the operations at S21 and the subsequent steps are repeated to monitor a fluctuation in the linear velocity of the belt. When the linear velocity of the resist roller in the detected driven-roller rotational information is off the range, it is determined whether the linear velocity of the resist roller is fast or slow, and the linear velocity of the resist roller is changed by one step (S25). The amount of change made by one step is set previously, and the linear velocity of the resist roller is changed by that amount. The same is true of the fixing rotary member (S26). After a change is made, the operations at S21 and the subsequent steps are repeated. The repetitive execution of the operations from S21 in the flowchart causes the linear velocity of the fixing rotary member to converge to the optimal value, which is maintained by monitoring the linear velocity. Accordingly, it is possible to cope with environmentally oriented changes or an aging change in the diameter of the roller. At S27, the number of times the setting of the linear velocity is repeated is monitored. When a change in setting is repeated consecutively, it is likely that slippage at the drive roller has occurred and the belt conveyance is unstable. Therefore, when the number of times the setting is changed exceeds a rated value, error is notified (S28).

As shown in FIG. 12, when the linear velocity of the resist roller and the linear velocity of the fixing rotary member are adjusted whenever necessary while the user uses the printer in the market, it is preferable to provide a set value for each paper tray. Many users place sheets of recording paper of different sizes or different thicknesses in the paper trays 3 and 4 shown in FIG. 2. By providing the set value for each tray, the optimal linear velocities of the resist roller and the fixing rotary member according to the type of paper are set quickly for image formation.

When the gripping force of the resist roller drops due to aging abrasion or adhesion of paper dust, the feeding of the recording paper becomes unstable, causing variation in the image forming position on the recording paper. That is, the top image position can vary for each recording paper. It is difficult for the image forming apparatus to identify this phenomenon. According to the scheme of the embodiment, therefore, reduction in the gripping force of the resist roller is detected. First, the inclination of the characteristic shown in FIG. 9 at the time of factory shipment is stored, and when the gripping force of the resist roller drops, the degree of the influence of the difference in the linear velocity of the resist roller decreases. As a result, the inclination of the characteristic shown in FIG. 9 becomes smaller with the reduction in the gripping force of the resist roller, and finally, even when the linear velocity of the resist roller changes, the feeding velocity of the belt is not influenced thereby. At the timing when the gripping force of the resist roller is likely to drop, the linear velocity of the resist roller is changed (the linear velocity is made faster or slower), the recording paper is fed, the characteristic is compared with the initial characteristic, and when there is a small change, the timing for replacement of the resist roller is notified in the image forming apparatus.

Although the image forming apparatus using the direct transfer system that directly transfers a toner image on the photoconductor onto a recording paper has been explained in this embodiment, the present invention can be adapted to an image forming apparatus using the intermediate transfer system.

Figure 13:
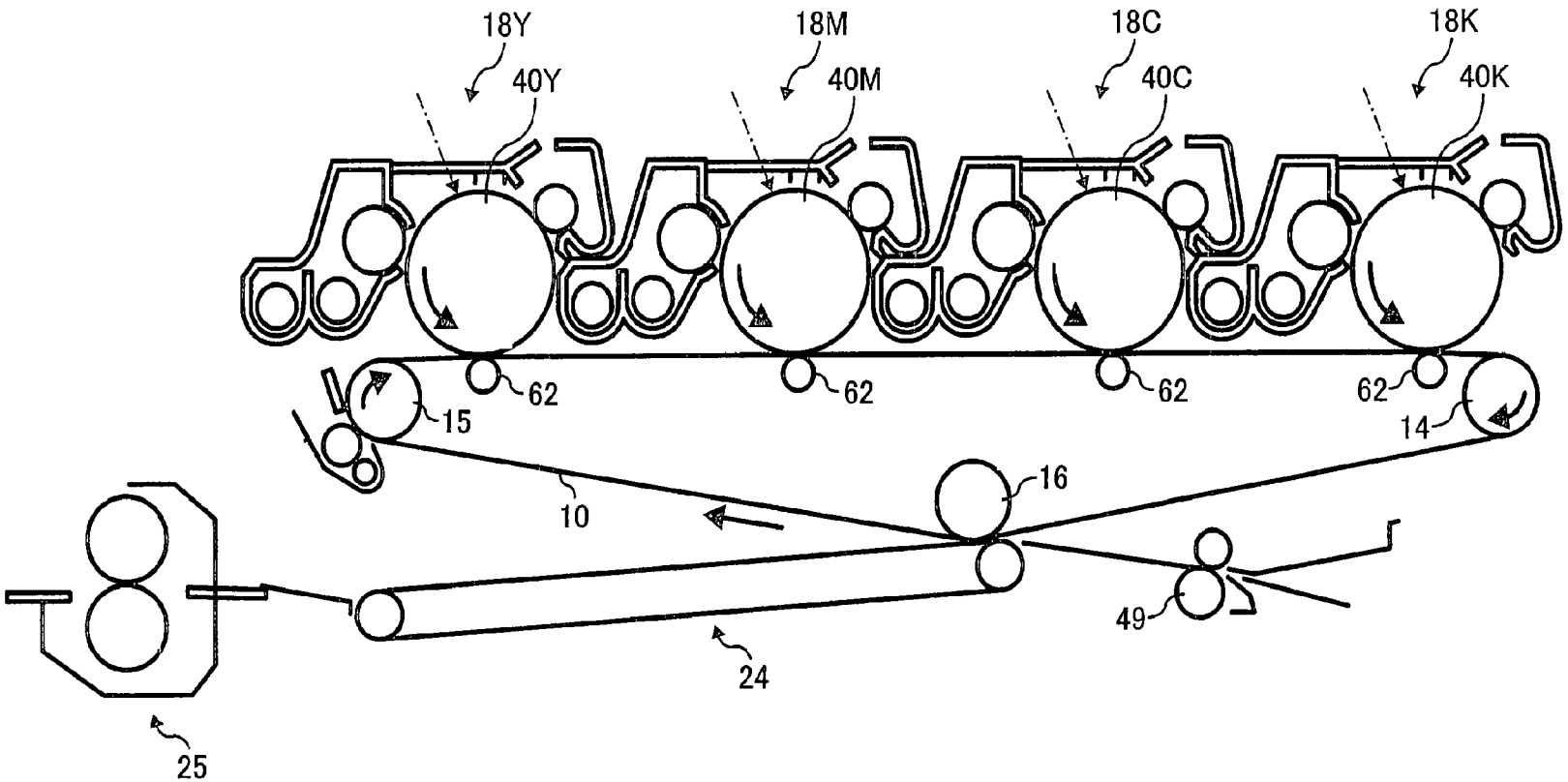
FIG. 13 is a schematic of a tandem type image forming apparatus using an intermediate transfer system.

FIG. 13 is a schematic configuration diagram of a tandem type image forming apparatus using the intermediate transfer system. In the image forming apparatus shown in FIG. 13, monochromatic images are formed on the surfaces of photoconductors 40Y, 40M, 40C, and 40K of image forming units 18Y, 18M, 18C, and 18K, respectively. The monochromatic images formed on the surfaces of the photoconductors 40Y, 40M, 40C, and 40K are sequentially transferred one on another onto an intermediate transfer belt 10, stretched across support rollers 14 to 16, by a transfer roller 62. Then, the overlapped images on the intermediate transfer belt 10 are transferred on a recording paper P at one time. The recording paper P with the images transferred thereon is fed out on a paper feeding belt 24, and the images on the recording paper P are fixed by a fixing device 25. The image forming apparatus acquires similar advantages by performing adjustment of the rotational velocities of the resist roller and the fixing rotary member (linear velocity adjustment) in a similar manner. Since the resist nip time at-which the recording paper P is held by a pair of resist rollers 49 in the image forming apparatus is short, the individual zones shown in FIG. 8 are shorter. It is therefore preferable to provide a high-resolution encoder.

According to the embodiment, regarding plural kinds of drive states where the resist roller 5*d* or the drive roller 65 is rotated at at least two different rotational velocities, the encoder 68 detects the driven-roller rotational information with the recording paper in contact with both the paper feeding belt 60 and the resist roller 5*d*. The driven-roller rotational information to be detected by the encoder 68 is the rotational displacement or the rotational velocity of the driven roller 63 whose value corresponds to the moving velocity of the paper feeding belt 60 that is moving in contact with the driven roller 63.

In a double contact mode where the recording paper is in contact with both the paper feeding belt 60 and the resist roller 5*d*, the moving velocity of the paper feeding belt 60 can fluctuate due to the paper feeding belt 60 being pushed or pulled by the recording paper fed to the resist roller 5*d*. In a single contact mode or a no contact mode where the recording paper is not in contact with at least one of the paper feeding belt 60 and the resist roller 5*d*, the resist roller 5*d* is separated from the paper feeding belt 60, and the moving velocity of the paper feeding belt 60 does not fluctuate due to the influence of the rotation of the resist roller 5*d*. By not changing the value of the driven-roller rotational information between the double contact mode and the single contact mode or the no contact mode, the moving velocity of the paper feeding belt 60 conveying the recording paper can be kept constant while the recording paper is fed out from the resist roller 5*d* and is fed on the paper feeding belt 60.

Therefore, the relationship that shows how the difference in driven-roller rotational information between the double contact mode and the single contact mode or the no contact mode is changed by the set value of the rotational velocity of at least one of the drive-roller driver and the resist-rotary-member driver is acquired based on plural pieces of driven-roller rotational information detected by the encoder 68 for the plural kinds of drive states. The rotational velocity to minimize a difference between a value of the driven-roller rotational information in the double contact mode and a value of the driven-roller rotational information in the single contact mode or the no contact mode can be acquired from the relationship between the rotational velocity and the driven-roller rotational information. It is possible to stably keep the state where the moving velocity of the paper feeding belt 60 conveying the recording paper matches with the feeding velocity of the recording paper of the resist roller 5*d* that feeds out the recording paper toward the paper feeding belt 60 by changing the set value of the rotational velocity of at least one of the drive-roller driver and the resist-rotary-member driver to the acquired rotational velocity, regardless of whether the recording paper is in contact with both the paper feeding belt 60 and the resist roller 5*d*.

It is unnecessary to acquire the correct values for the diameter of the resist roller 5*d*, the diameter of the driven roller 63, the thickness of the paper feeding belt 60, and the like, which differ for each apparatus due to a difference in the precision at the time of manufacturing the apparatus. Therefore, it is possible to stably keep the state where the moving velocity of the paper feeding belt 60 matches with the recording paper feeding velocity of the resist roller 5*d*, regardless of the size precision of the individual parts of each apparatus.

According to the embodiment, regarding plural kinds of drive states where the resist roller 5*d* or the drive roller 65 is rotated at at least two different rotational velocities, the encoder 68 can detect the driven-roller rotational information when the trailing end of the recording paper in contact with the paper feeding belt 60 passes the resist roller 5*d*.

When the trailing end of the recording paper in contact with the paper feeding belt 60 passes the resist roller 5*d*, the moving velocity of the paper feeding belt 60 is likely to fluctuate due to the paper feeding belt 60 being pushed or pulled by the recording paper fed to the resist roller 5*d*. By not changing the value of the driven-roller rotational information when the trailing end of the recording paper passes the resist roller 5*d*, the moving velocity of the paper feeding belt 60 conveying the recording paper can be kept constant while the recording paper is fed out from the resist roller 5*d* and is fed on the paper feeding belt 60.

The relationship that shows how the amount of a change in the value of the driven-roller rotational information when the trailing end of the recording paper in contact with the paper feeding belt 60 passes the resist roller 5*d* is changed by the set value of the rotational velocity of at least one of the drive-roller driver and the resist-rotary-member driver is acquired based on plural pieces of driven-roller rotational information detected by the encoder 68 for the plural kinds of drive states. The rotational velocity to minimize a change in the value of the driven-roller rotational information can be acquired from the relationship. It is possible to stably keep the state where the moving velocity of the paper feeding belt 60 conveying the recording paper matches with the feeding velocity of the recording paper of the resist roller 5*d* that feeds out the recording paper toward the paper feeding belt 60 by changing the set value of the rotational velocity of at least one of the drive-roller driver and the resist-rotary-member driver to the acquired rotational velocity, regardless of whether the recording paper is in contact with both the paper feeding belt 60 and the resist roller 5*d*.

It is unnecessary to acquire the correct values for the diameter of the fixing rotary member, the diameter of the driven roller 63, the thickness of the paper feeding belt 60, and the like, which differ for each apparatus due to a difference in the precision at the time of manufacturing the apparatus. Therefore, it is possible to stably keep the state where the moving velocity of the paper feeding belt 60 matches with the recording paper feeding velocity of the resist roller 5*d*, regardless of the size precision of the individual parts of each apparatus.

Changing the set value of the rotational velocity can use the amount of a change in the value of driven-roller rotational information when the leading end of the recording paper is in contact with the paper feeding belt 60 while the recording paper is being fed by the resist roller 5*d*, in place of the amount of a change in the value of driven-roller rotational information when the trailing end of the recording paper in contact with the paper feeding belt 60 passes the resist roller 5*d*.

According to the embodiment, changing the set value of the rotational velocity similar to the above example can be performed even when the recording paper on the paper feeding belt 60 is fed to the fixing rotary member 7*a* and the fixing belt 7*b*.

According to the embodiment, regarding plural kinds of drive states where the fixing rotary member 7*a*, 7*d*, or the drive roller 65 is rotated at at least two different rotational velocities, the encoder 68 detects the driven-roller rotational information with the recording paper in contact with both the paper feeding belt 60 and the fixing rotary member. The driven-roller rotational information to be detected by the encoder 68 is the rotational displacement or the rotational velocity of the driven roller 63 whose value corresponds to the moving velocity of the paper feeding belt 60 that is moving in contact with the driven roller 63.

In a double contact mode where the recording paper is in contact with both the paper feeding belt 60 and the fixing rotary member, the moving velocity of the paper feeding belt 60 can fluctuate due to the paper feeding belt 60 being pushed or pulled by the recording paper fed while being held by the fixing rotary member. In a single contact mode or a no contact mode where the recording paper is not in contact with at least one of the paper feeding belt 60 and the fixing rotary member, the fixing rotary member is separated from the paper feeding belt 60, and the moving velocity of the paper feeding belt 60 does not fluctuate due to the influence of the rotation of the fixing rotary member. By not changing the value of the driven-roller rotational information between the double contact mode and the single contact mode or the no contact mode, the moving velocity of the paper feeding belt 60 conveying the recording paper can be kept constant between the point when the recording paper is fed on the paper feeding belt 60 and the point when the recording paper is held and fed by the fixing rotary member.

The relationship that shows how the difference in driven-roller rotational information between the double contact mode and the single contact mode or the no contact mode is changed by the set value of the rotational velocity of at least one of the drive-roller driver and the fixing-rotary-member driver is acquired based on plural pieces of driven-roller rotational information detected by the encoder 68 for the plural kinds of drive states. The rotational velocity to minimize a difference between a value of the driven-roller rotational information in the double contact mode and a value of the driven-roller rotational information in the single contact mode or the no contact mode can be acquired from the relationship. It is possible to stably keep the state where the moving velocity of the paper feeding belt 60 conveying the recording paper matches with the recording paper feeding velocity of the fixing rotary member that feeds out the recording paper received from the paper feeding belt 60 while holding the recording paper by changing the set value of the rotational velocity of at least one of the drive-roller driver and the fixing-rotary-member driver to the acquired rotational velocity, regardless of whether the recording paper is in contact with both the paper feeding belt 60 and the fixing rotary member 7*a* or 7*b*.

It is unnecessary to acquire the correct values for the diameter of the fixing rotary member, the diameter of the driven roller 63, the thickness of the paper feeding belt 60, and the like, which differ for each apparatus due to a difference in the precision at the time of manufacturing the apparatus. Therefore, it is possible to stably keep the state where the moving velocity of the paper feeding belt 60 matches with the recording paper feeding velocity of the resist roller 5*d*, regardless of the size precision of the individual parts of each apparatus.

According to the embodiment, regarding plural kinds of drive states where the fixing rotary member 7*a* or 7*b*, or the drive roller 65 is rotated at at least two different rotational velocities, the encoder 68 can detect the driven-roller rotational information when the trailing end of the recording member passes the paper feeding belt 60 while the recording paper is held by the fixing rotary member.

When the trailing end of the recording member passes the paper feeding belt 60 while the recording paper is held by the fixing rotary member, the moving velocity of the paper feeding belt 60 is likely to fluctuate due to the paper feeding belt 60 being pushed or pulled by the recording paper fed to the fixing rotary member. By not changing the value of the driven-roller rotational information when the trailing end of the recording paper passes the paper feeding belt 60, the moving velocity of the paper feeding belt 60 conveying the recording paper can be kept constant between the point when the recording paper is fed on the paper feeding belt 60 and the point when the recording paper is fed while being held by the fixing rotary member.

The relationship that shows how the amount of a change in the value of the driven-roller rotational information when the trailing end of the recording member passes the paper feeding belt 60 while the recording paper is held by the fixing rotary member is changed by the set value of the rotational velocity of at least one of the drive-roller driver and the fixing-rotary-member driver is acquired based on plural pieces of driven-roller rotational information detected by the encoder 68 for the plural kinds of drive states. The rotational velocity to minimize the change in the value of the driven-roller rotational information can be acquired from the relationship. It is possible to stably keep the state where the moving velocity of the paper feeding belt 60 conveying the recording paper matches with the recording paper feeding velocity of the fixing rotary member that feeds out the recording-paper received from the paper feeding belt 60 while holding the recording paper by changing the set value of the rotational velocity of at least one of the drive-roller driver and the resist-rotary-member driver to the acquired rotational velocity, regardless of whether the recording paper is in contact with both the paper feeding belt 60 and the fixing rotary member 7*a* or 7*b*.

It is unnecessary to acquire the correct values for the diameter of the fixing rotary member, the diameter of the driven roller 63, the thickness of the paper feeding belt 60, and the like, which differ for each apparatus due to a difference in the precision at the time of manufacturing the apparatus. Therefore, it is possible to stably keep the state where the moving velocity of the paper feeding belt 60 matches with the recording paper feeding velocity of the resist roller 5*d*, regardless of the size precision of the individual parts of each apparatus.

changing the set value of the rotational velocity can use the amount of a change in the value of driven-roller rotational information when the leading end of the recording paper being in contact with the paper feeding belt 60 and being fed passes the fixing rotary member, in place of the amount of a change in the value of driven-roller rotational information when the trailing end of the recording paper being held by the fixing rotary member passes the paper feeding belt 60.

According to the embodiment, changing the set value of the rotational velocity similar to the above example can be performed even when the drive-roller driver is subjected to feedback control so that the result of detecting the driven-roller rotational information (rotational angular velocity or rotational angular change) by the encoder 68 becomes a predetermined control target value.

According to the embodiment, regarding plural kinds of drive states where the resist-rotary-member driver rotates the resist roller 5*d* at at least two different rotational velocities, drive-roller drive-information consisting of rotational information or drive control information of the drive-roller driver with the recording paper in contact with both the paper feeding belt 60 and the resist roller 5*d* is acquired. The drive-roller drive information can be acquired for plural kinds of drive states where the drive-roller driver is subjected to feedback control so that the drive-roller driver drives the drive roller 65 at at least two different rotational velocities of the drive-roller drive information, the rotational information is information about the rotation of the drive motor, and corresponds to the rotational information (rotational velocity) of the motor shaft when the drive motor is a direct current (DC) servo motor or the like whose motor shaft includes a magnetic or an optical rotary sensor. The drive control information is information about the amount of an operation to be input to the drive-roller driver. For a DC motor, the drive control information corresponds to the value or the like of the voltage applied to or the current supplied to the DC motor. For a stepping motor, the drive control information corresponds to the frequency of the input pulse or the like supplied to the stepping motor.

With the feedback control in progress, in the double contact mode where the recording paper is in contact with both the paper feeding belt 60 and the resist roller 5*d*, the moving velocity of the paper feeding belt 60 can fluctuate due to the paper feeding belt 60 being pushed or pulled by the recording paper fed to the resist roller 5*d*. To suppress the fluctuation in the moving velocity of the paper feeding belt 60, the drive-roller driver is subjected to feedback control so that the detection result of the driven-roller rotational information (rotational angular velocity or rotational angular change) becomes a predetermined control target value. At the time of the feedback control, the rotational information or the drive control information of the drive-roller driver is changed. In the single contact mode or the no contact mode where the recording paper is not in contact with at least one of the paper feeding belt 60 and the resist roller 5*d*, the resist roller 5*d* is separated from the paper feeding belt 60, and the moving velocity of the paper feeding belt 60 does not fluctuate due to the influence of the rotation of the resist roller 5*d*. By not changing the value of the rotational information or the drive control information of the drive-roller driver between the double contact mode and the single contact mode or the no contact mode, the moving velocity of the paper feeding belt 60 conveying the recording paper can be kept constant while the recording paper is fed out from the resist roller 5*d* and is fed on the paper feeding belt 60.

The relationship that shows how the difference in the value of the drive-roller drive information between the double contact mode and the single contact mode or the no contact mode is changed by the set value of the rotational velocity of at least one of the drive-roller driver and the resist-roller driver is acquired based on the result of acquiring the rotational information or the drive control information of the drive-roller driver. The rotational velocity to minimize a difference between the value of the drive-roller drive information in the double contact mode and the value of the driven-roller drive information in the single contact mode or the no contact mode can be acquired from this relationship. It is possible to stably keep the state where the moving velocity of the paper feeding belt 60 conveying the recording paper matches with the feeding velocity of the recording paper of the resist roller 5*d* that feeds out the recording paper toward the paper feeding belt 60 by changing the set value of the rotational velocity of at least one of the drive-roller driver and the resist-rotary-member driver to the acquired rotational velocity, regardless of whether the recording paper is in contact with both the paper feeding belt 60 and the resist roller 5*d*.

According to the embodiment, regarding plural kinds of drive states where the resist-rotary-member driver rotates the resist roller 5*d* at at least two different rotational velocities, drive-roller drive information consisting of rotational information or drive control information of the drive-roller driver when the trailing end of the recording member in contact with the paper feeding belt 60 passes the resist roller 5*d* can be acquired. The drive-roller drive information can be acquired for plural kinds of drive states where the drive-roller driver is subjected to feedback control so that the drive-roller driver drives the drive roller 65 at at least two different rotational velocities.

With the feedback control in progress, when the trailing end of the recording paper passes the resist roller 5*d* while the recording paper is in contact with the paper feeding belt 60, the moving velocity of the paper feeding belt 60 can fluctuate due to the paper feeding belt 60 being pushed or pulled by the recording paper fed to the resist roller 5*d*. To suppress the fluctuation in the moving velocity of the paper feeding belt 60, the drive-roller driver is subjected to feedback control so that the detection result of the driven-roller rotational information (rotational angular velocity or rotational angular change) becomes a predetermined control target value. At the time of the feedback control, the rotational information or the drive control information of the drive-roller driver is changed. The moving velocity of the paper feeding belt 60 conveying the recording paper can be kept constant while the recording paper is fed out from the resist roller 5*d* and is fed on the paper feeding belt 60.

Based on the drive-roller drive information acquired in the plural kinds of drive states, the relationship that shows how the amount of a change in the value of the drive-roller drive information when the trailing end of the recording paper in contact with the paper feeding belt 60 passes the resist roller 5*d* is changed by the set value of the rotational velocity of at least one of the drive-roller driver and the resist-rotary-member driver is acquired. The rotational velocity to minimize the amount of the change in the value of the drive-roller drive information can be acquired from the relationship. It is possible to stably keep the state where the moving velocity of the paper feeding belt conveying the recording paper matches with the feeding velocity of the recording paper of the resist roller 5*d* that feeds out the recording paper toward the paper feeding belt 60 by changing the set value of the rotational velocity of at least one of the drive-roller driver and the resist-rotary-member driver to the acquired rotational velocity, regardless of whether the recording paper is in contact with both the paper feeding belt 60 and the resist roller 5*d*.

Changing the set value of the rotational velocity can use the amount of a change in the value of the drive-roller drive information when the leading end of the recording paper is in contact with the paper feeding belt 60 while the recording paper is being fed by the resist roller 5*d*, in place of the amount of a change in the value of the drive-roller drive information when the trailing end of the recording paper in contact with the paper feeding belt 60 passes the resist roller 5*d*.

According to the embodiment, in executing the feedback control, changing the set value of the rotational velocity similar to the above example can be performed even when the recording paper on the paper feeding belt 60 is fed to the fixing rotary member 7*a* and fixing belt 7*b*.

For example, regarding plural kinds of drive states where the fixing-rotary-member driver rotates the fixing rotary member 7*a* and fixing belt 7*b* at at least two different rotational velocities, drive-roller drive information consisting of rotational information or drive control information of drive-roller driver with the recording paper in contact with both the paper feeding belt 60 and the fixing rotary member is acquired. The drive-roller drive information can be acquired for plural kinds of drive states where the drive-roller driver is subjected to feedback control so that the drive-roller driver drives the drive roller 65 at at least two different rotational velocities.

With the feedback control in progress, in the double contact mode where the recording paper is in contact with both the paper feeding belt 60 and the fixing rotary member, the moving velocity of the paper feeding belt 60 can fluctuate due to the paper feeding belt 60 being pushed or pulled by the recording paper fed to the fixing rotary member. To suppress the fluctuation in the moving velocity of the paper feeding belt 60, the drive-roller driver is subjected to feedback control so that the detection result of the driven-roller rotational information (rotational angular velocity or rotational angular change) becomes a predetermined control target value. At the time of the feedback control, the rotational information or the drive control information of the drive-roller driver is changed. In the single contact mode or the no contact mode where the recording paper is not in contact with at least one of the paper feeding belt 60 and the fixing rotary member, the fixing rotary member is separated from the paper feeding belt 60, and the moving velocity of the paper feeding belt 60 does not fluctuate due to the influence of the rotation of the fixing rotary member. By not changing the value of the drive-roller drive information between the double contact mode and the single contact mode or the no contact mode, the moving velocity of the paper feeding belt 60 conveying the recording paper can be kept constant while the recording paper is fed out from the fixing rotary member and is fed on the paper feeding belt 60.

Based on the drive-roller drive information acquired for the plural kinds of drive states, the relationship that shows how the difference in drive-roller drive information between the double contact mode and the single contact mode or the no contact mode is changed by the set value of the rotational velocity of at least one of the drive-roller driver and the fixing-rotary-member driver is acquired. The rotational velocity to minimize a difference between the value of the drive-roller drive information in the double contact mode and the value of the driven-roller rotational information in the single contact mode or the no contact mode can be acquired from the relationship. It is possible to stably keep the state where the moving velocity of the paper feeding belt 60 conveying the recording paper matches with the recording paper feeding velocity of the fixing rotary member that feeds out the recording paper received from the paper feeding belt 60 while holding the recording paper by changing the set value of the rotational velocity of at least one of the drive-roller driver and the fixing-rotary-member driver to the acquired rotational velocity, regardless of whether the recording paper is in contact with both the paper feeding belt 60 and the fixing rotary member 7*a* or 7*b*.

According to the embodiment, regarding plural kinds of drive states where the fixing-rotary-member driver rotates the fixing rotary member 7*a* and fixing belt 7*b* at at least two different rotational velocities, drive-roller drive information consisting of rotational information or drive control information of drive-roller driver when the trailing end of the recording member passes the paper feeding belt 60 while the recording member is held by the fixing rotary member is acquired. The drive-roller drive information can be acquired for plural kinds of drive states where the drive-roller driver is subjected to feedback control so that the drive-roller driver drives the drive roller 65 at at least two different rotational velocities.

When the trailing end of the recording member passes the paper feeding belt 60 while the recording paper is held by the fixing rotary member, the moving velocity of the paper feeding belt 60 is likely to fluctuate due to the paper feeding belt 60 being pushed or pulled by the recording paper held and fed to the fixing rotary member. To suppress the fluctuation in the moving velocity of the paper feeding belt 60, the drive-roller driver is subjected to feedback control so that the detection result of the driven-roller rotational information (rotational angular velocity or rotational angular change) becomes a predetermined control target value. At the time of the feedback control, the rotational information or the drive control information of the drive-roller driver is changed. By not changing the value of the drive-roller drive information when the trailing end of the recording-paper passes the paper feeding belt 60, the moving velocity of the paper feeding belt 60 conveying the recording paper can be kept constant while the recording paper is fed out from the fixing rotary member and is fed on the paper feeding belt 60.

Based on the drive-roller drive information acquired for the plural kinds of drive states, the relationship that shows how the amount of a change in the value of drive-roller drive information when the trailing end of the recording member passes the paper feeding belt 60 while the recording paper is held by the fixing rotary member is changed by the set value of the rotational velocity of at least one of the drive-roller driver and the resist-rotary-member driver is acquired. The rotational velocity to minimize the change in the value of the drive-roller drive information can be acquired from the relationship. It is possible to stably keep the state where the moving velocity of the paper feeding belt 60 conveying the recording paper matches with the recording paper feeding velocity of the fixing rotary member that feeds out the recording paper received from the paper feeding belt 60 while holding the recording paper by changing the set value of the rotational velocity of at least one of the drive-roller driver and the resist-rotary-member driver to the acquired rotational velocity, regardless of whether the recording paper is in contact with both the paper feeding belt 60 and the fixing rotary member 7*a* or 7*b*.

Changing the set value of the rotational velocity can use the amount of a change in the value of drive-roller drive information when the leading end of the recording paper passes the fixing rotary member while the recording paper is fed by being in contact with the paper feeding belt 60, in place of the amount of a change in the value of drive-roller drive information when the trailing end of the recording paper held by the fixing rotary member passes the paper feeding belt 60.

In detecting a fluctuation in the moving velocity of the paper feeding belt 60 due to the setting error of the rotational velocity of the resist roller 5*d* (resist linear velocity) or the rotational velocity of the fixing rotary member (fixing linear velocity) in the embodiment, the fluctuation in the moving velocity of the paper feeding belt 60 originating mainly from the deviation of the film thickness over one turn of the paper feeding belt 60 becomes a detection noise. The fluctuation in the moving velocity of the paper feeding belt 60 originating from the deviation of the film thickness is the phenomenon in which the moving velocity of the paper feeding belt 60 increases when the thick portion of the belt runs over the drive roller 65, whereas the moving velocity of the paper feeding belt 60 decreases when the thin portion of the belt runs over the drive roller 65. The detection noise should be removed to adjust the resist linear velocity or the fixing linear velocity with high accuracy with respect to the moving velocity of the paper feeding belt 60 (belt moving velocity).

A belt home position mark as a mark member is provided at at least one position on the paper feeding belt 60 in the circumferential direction in the embodiment. A mark detector (mark sensor) detects the home position mark with the paper feeding belt 60 rotated by one turn or more. The controller 70 which also serves as a rotational-period-fluctuation component extracting unit extracts a rotational period fluctuation component generated in one rotational period of the belt included in the driven-roller rotational information, detected by the encoder 68, based on the result of the detection, and stores the extracted component in an internal memory as a storage unit. At the time a fluctuation in the moving velocity of the paper feeding belt 60 is detected, it is possible to remove the rotational period fluctuation component of the belt based on the belt home position mark prestored in the internal memory, which ensures high-precision detection.

In executing the feedback control, the controller 70 also serving as the rotational-period-fluctuation component extracting unit extracts a rotational period fluctuation component generated in one rotational period of the belt included in drive-roller drive information, acquired in the feedback control, based on the detection result from the mark sensor, and stores the extracted component in the internal memory as the storage unit. At the time a fluctuation in the drive-roller drive information is detected, it is possible to remove the rotational period fluctuation component of the belt based on the belt home position mark prestored in the internal memory, which ensures high-precision detection.

According to the embodiment, the driven-roller rotational information or the drive-roller drive information can be subjected to moving averaging with the number of pieces of information obtained over a time that is an integer multiple of the rotational period of the drive transmission system. The drive-roller drive information (rotational information) under feedback control or data which is acquired from the encoder 68, fluctuates in the rotational period of the drive transmission system (drive roller and gears). Similarly to the fluctuation in the rotational period of the belt, the fluctuation also becomes a detection noise on the fluctuation in the moving velocity of the paper feeding belt 60. As these fluctuations are harmonic fluctuations as compared with the belt rotational period, they can be removed easily by performing moving averaging with the number of pieces of information obtained over a time that is an integer multiple of the rotational period of the drive transmission system. This ensures high-precision detection.

According to the embodiment, the driven-roller rotational information or the drive-roller drive information can be averaged for plural sheets of recording paper. The driven-roller rotational information or the drive-roller drive information when plural sheets of recording paper are fed out is temporarily stored in the internal memory as a storage unit, and is averaged for the sheets of recording paper before being used. The data obtained from the encoder 68 or the data on the drive-roller drive information (motor rotational data) under the feedback control contains a random fluctuation component due to slippage between the drive roller 65 and the paper feeding belt 60 and slippage between the paper feeding belt 60 and the recording paper. The use of driven-roller rotational information or drive-roller drive information averaged for the sheets of recording paper can suppress the random fluctuation. This ensures high-precision detection.

According to the embodiment, in executing the feedback control, the ratio of the rotational velocity of the drive roller 65 to the rotational velocity of the lower right driven roller 63 (driven roller) whose rotation is detected by the encoder 68 can be detected from the driven-roller rotational information or the drive-roller drive information. As the ratio of the rotational velocity of the drive roller 65 to the rotational velocity of the lower right driven roller 63 (driven roller), i.e., the ratio of the diameters of the two rollers can be identified accurately, the belt feeding velocity does not change between the enabled feedback control and the disabled feedback control. By executing adjustment (linear velocity adjustment) of changing the set value of the rotational velocity in either the enabled feedback control or the disabled feedback control, the linear velocity adjustment can be completed.

According to the embodiment, there is provided a toner pattern detector that detects a toner pattern transferred to the paper feeding belt 60 from each photoconductor 11. The difference between the rotational velocity of the photoconductor and the feeding velocity of the paper feeding belt 60 can be set based on the value of the width of the toner pattern, transferred on the paper feeding belt 60 from the photoconductor, in the feed direction of the belt. Driving of the resist-rotary-member driver or the fixing-rotary-member driver can be controlled according to the feeding velocity of the paper feeding belt 60 having the difference. In this case, the linear velocities of the photoconductor and the paper feeding belt can be set to provide an adequate linear velocity difference by detecting the stretching or contraction of the toner pattern originating from the linear velocity difference. Then, the linear velocity of the paper feeding belt is determined to adjust the rotational velocity of the resist roller and the fixture-rotary member (linear velocity adjustment). With this arrangement, it is possible to smoothly adjust all of the linear velocities of the photoconductor, the paper feeding belt, the resist roller, and the fixing rotary member to the adequate linear velocities.

According to the embodiment, a paper sensor as a recording member detector that detects the recording paper is provided at a position closer to the paper feeding belt 60, the resist roller 5*d*, or the fixing rotary member 7*a* or 7*b* by a distance longer than the length of the recording paper in the feed direction of the recording member. By using the output of the paper sensor, it is possible to accurately detect from the feeding velocity of the recording paper and the detection timing for the leading end or the trailing end of the recording paper whether it is in the double contact mode where the recording paper is in contact with both the resist roller 5*d* and the paper feeding belt 60, the single contact mode where the recording paper is in contact with only the paper feeding belt 60, or the mode where the recording paper is in contact with both the fixing rotary member 7*a* or 7*b* and the paper feeding belt 60.

According to the embodiment, the recording member can be made mainly of a paper material, and can have undergone an image fixing process that involves heating at least once. In this case, since heat is applied to the recording paper in the fixing process executed once, the water content is reduced. This improves the adhesion of the recording member to the paper feeding belt 60, thereby increasing the detection precision.

According to the embodiment, changing the set value of the rotational velocity can be executed in the process of manufacturing the image forming apparatus. In this case, the rotational velocity of at least one of the drive-roller driver, the resist-roller driver, and the fixing-rotary-member driver (the linear velocities of the drive roller, the resist roller, and the fixing rotary member) can be set adequately without affecting the user's usage.

According to the embodiment, changing the set value of the rotational velocity can be executed when any one of the resist roller 5*d*, the paper feeding belt 60, the drive roller 65, the lower right driven roller 63 (driven roller), and the fixing rotary member 7*a* or 7*b*, or a unit including any one of the parts is replaced. In this case, even when the paper feeding velocity is changed by replacement of the parts, the rotational velocity of at least one of the drive-roller driver, the resist-roller driver, and the fixing-rotary-member driver (the linear velocities of the drive roller, the resist roller, and the fixing rotary member) can be set immediately and adequately.

According to the embodiment, changing the set value of the rotational velocity can be executed in the user use period during which the user uses the image forming apparatus. In this case, even when the paper feeding velocity is changed by replacement of the parts, the rotational velocity of at least one of the drive-roller driver, the resist-roller driver, and the fixing-rotary-member driver (the linear velocities of the drive roller, the resist roller, and the fixing rotary member) can be set adequately according to the use environment (temperature and humidity) of the image forming apparatus and aging changes in the parts.

According to the embodiment, the timing for replacement of the resist roller 5*d* can be notified when the value of the driven-roller rotational information or the value of the drive-roller drive information is compared with the initial value of that information and the difference between the two values exceeds the predefined range. In this case, the gripping force of the resist roller 5*d* which drops with the time can be determined, so that replacement of the resist roller 5*d* can be notified at the adequate timing.

According to the embodiment, the set value of the rotational velocity can be changed based on driven-roller rotational information consisting of two kinds of information, namely the rotational displacement and the rotational velocity, or drive-roller drive information consisting of two kinds of information, namely the rotational information and the drive control information. In this case, the optimal linear velocity is set from plural pieces of information, thus ensuring high-precision adjustment.

According to the embodiment, the rotational velocity can be set for each of plural recording member accommodating units (paper trays 3 and 4). Even when sheets of recording paper of different types are placed on the respective paper trays, image formation can be carried out quickly with the optimal rotational velocity set (linear velocity setting) for each type of recording paper.

According to the embodiment, the rotational velocity can be set for each of plural types of recording members of different thicknesses. In this case, image formation can be carried out quickly with the optimal rotational velocity set (linear velocity setting) for each of the sheets of recording paper of different thicknesses.

When the embodiment is adapted to a tandem type image forming apparatus using the intermediate transfer system which uses an intermediate transfer body (intermediate transfer belt) including an endless belt, it is possible to stably and accurately keep the state where the moving velocity of the intermediate transfer belt matches with the recording member feeding velocity of the resist roller, or the recording member feeding velocity of the fixing rotary member, regardless of the precision of the parts of each product.

According to an aspect of the present invention, it is impossible to stably keep the state where the moving velocity of the belt conveying the recording member matches with the feeding velocity of the recording member of the resist rotary member that feeds out the recording member toward the belt by changing the set value of the rotational velocity of at least one of the drive-roller driver and the resist-rotary-member driver to the determined rotational velocity, regardless of whether the recording member is in contact with both the belt and the resist rotary member.

Furthermore, it is possible to stably keep the state where the moving velocity of the belt matches with the recording member feeding velocity of the resist rotary member, regardless of the size precision of the individual parts of each apparatus.

Moreover, it is possible to stably keep the state where the moving velocity of the belt conveying the recording member matches with the recording member feeding velocity of the fixing rotary member that feeds the recording member received from the belt while holding the recording member, by changing the set value of the rotational velocity of at least one of the drive-roller driver and the fixing-rotary-member driver to the determined target value of the rotational velocity, regardless of whether the recording member is in contact with both the belt and the resist rotary member.

Furthermore, it is possible to stably keep the state where the moving velocity of the belt matches with the recording member feeding velocity of the fixing rotary member, regardless of the size precision of the individual parts of each apparatus.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a belt endlessly stretched across a drive roller and a plurality of driven rollers;

a drive-roller driver configured to rotate the drive roller at a plurality of different first velocities;

a detector that detects information representative of any one of a rotational displacement and a velocity of at least one driven roller;

a fixing rotary member that fixes an image formed on a recording medium conveyed on the belt by sandwiching the recording medium with the belt;

a fixing-rotary-member driver configured to rotate the fixing rotary member at a plurality of different second velocities;

a rotation controlling unit configured to rotate any one of the drive roller with the first velocities and the fixing rotary member with the second velocities, and obtains a correlation between information detected by the detector and any one of the first velocities and the second velocities; and a target velocity determining unit that determines a target velocity at which a difference between information when the recording medium is in contact with both the belt and the fixing rotary member and information when the recording medium is not in contact with at least any one of the belt and the fixing rotary member is minimum from the correlation, wherein any one of the drive-roller driver rotates the drive roller and the fixing-rotary-member driver rotates the fixing rotary member at the target velocity.

2. An image forming apparatus comprising:

a belt endlessly stretched across a drive roller and a plurality of driven rollers;

a drive-roller driver configured to rotate the drive roller at a plurality of different first velocities;

a detector that detects information representative of any one of a rotational displacement and a velocity of at least one driven roller;

a fixing rotary member that fixes an image formed on a recording medium conveyed on the belt by sandwiching the recording medium with the belt;

a fixing-rotary-member driver configured to rotate the fixing rotary member at a plurality of different second velocities;

a rotation controlling unit configured to rotate any one of the drive roller with the first velocities and the fixing rotary member with the second velocities, and obtains a correlation between information detected by the detector and any one of the first velocities and the second velocities; and a target velocity determining unit that determines a target velocity at which a fluctuation magnitude of information when a trailing end of the recording medium passes the fixing rotary member while the recording medium is in contact with the belt from the correlation, wherein any one of the drive-roller driver rotates the drive roller and the fixing-rotary-member driver rotates the fixing rotary member at the target velocity.

3. An image forming apparatus comprising:

a belt endlessly stretched across a drive roller and a plurality of driven rollers;

a drive-roller driver configured to rotate the drive roller at a plurality of different first velocities;

a detector that detects information representative of any one of a rotational displacement and a velocity of at least one driven roller;

a fixing rotary member that feeds out a recording medium on the belt at a predetermined timing;

a fixing-rotary-member driver configured to rotate the fixing rotary member at a plurality of different second velocities;

a rotation controlling unit configured to cause any one of the drive-roller driver to be subjected to a feedback control so that the information detected by the detector becomes a target information and the drive roller is rotated at first velocities and the fixing rotary member to be rotated at the second velocities, acquire a plurality of control information representative of any one of drive information with which the drive roller is rotating or drive-roller driving information output by the controller when the recording medium is in contact with both the belt and the fixing rotary member, and obtain a correlation between the information detected by the detector and any one of the first velocities and the second velocities based on the control information acquired; and a target velocity determining unit that determines a target velocity at which a difference between control information when the recording medium is in contact with both the belt and the fixing rotary member and control information when the recording medium is not in contact with at least any one of the belt and the fixing rotary member is minimum from the correlation, wherein any one of the drive-roller driver rotates the drive roller and the fixing-rotary-member driver rotates the fixing rotary member at the target velocity.

4. An image forming apparatus comprising:

a belt endlessly stretched across a drive roller and a plurality of driven rollers;

a drive-roller driver configured to rotate the drive roller at a plurality of different first velocities;

a detector that detects information representative of any one of a rotational displacement and a velocity of at least one driven roller;

a fixing rotary member that feeds out a recording medium on the belt at a predetermined timing;

a fixing-rotary-member driver configured to rotate the fixing rotary member at a plurality of different second velocities;

a rotation controlling unit configured to cause any one of the drive-roller driver to be subjected to a feedback control so that the information detected by the detector becomes a target information and the drive roller is rotated at first velocities and the fixing rotary member to be rotated at the second velocities, acquire a plurality of control information representative of any one of drive information with which the drive roller is rotating or drive-roller driving information output by the controller when the recording medium is in contact with both the belt and the fixing rotary member, and obtain a correlation between the information detected by the detector and any one of the first velocities and the second velocities based on the control information acquired; and a target velocity determining unit that determines a target velocity at which a fluctuation magnitude of control information when a trailing end of the recording medium passes the fixing rotary member while the recording medium is in contact with the belt from the correlation, wherein any one of the drive-roller driver rotates the drive roller and the fixing-rotary-member driver rotates the fixing rotary member at the target velocity.

* * * * *